US006212918B1

(12) United States Patent
Kravtin

(10) Patent No.: US 6,212,918 B1
(45) Date of Patent: Apr. 10, 2001

(54) LOCKING MECHANISM FOR PORTABLE VALUABLES

(75) Inventor: Benson H. Kravtin, Brooklyn, NY (US)

(73) Assignee: Benson Enterprises Incorporated, Brooklyn, NY (US)

( * ) Notice: Subject to any disclaimer, the term of this patent is extended or adjusted under 35 U.S.C. 154(b) by 0 days.

(21) Appl. No.: 09/160,555

(22) Filed: Sep. 24, 1998

(51) Int. Cl.[7] ..... E05B 73/00
(52) U.S. Cl. ..... 70/14; 70/58; 248/551
(58) Field of Search ..... 70/14, 18, 57, 70/58, 427, 428, 429, 430; 248/551–553

(56) References Cited

U.S. PATENT DOCUMENTS

| | | | | |
|---|---|---|---|---|
| 4,742,703 | | 5/1988 | DeWalch et al. | 70/366 |
| 4,819,464 | | 4/1989 | Kuo | 70/18 |
| 5,117,661 | * | 6/1992 | Carl et al. | 70/14 |
| 5,305,621 | * | 4/1994 | Broadwater | 70/14 |
| 5,327,752 | | 7/1994 | Myers et al. | 70/58 |
| 5,355,272 | * | 10/1994 | Kung | 70/14 X |
| 5,377,512 | * | 1/1995 | Kelley | 70/14 X |
| 5,381,685 | | 1/1995 | Carl et al. | 70/78 |
| 5,493,878 | | 2/1996 | Murray, Jr. et al. | 70/58 |
| 5,502,989 | | 4/1996 | Murray, Jr. et al. | 70/58 |
| 5,687,592 | * | 11/1997 | Penniman et al. | 70/14 |
| 5,722,268 | * | 3/1998 | Choi | 70/57 X |
| 5,787,737 | * | 8/1998 | Cho | 70/57 X |
| 5,787,738 | * | 8/1998 | Brandt et al. | 70/14 X |
| 5,791,171 | * | 8/1998 | Kelley | 70/57 X |
| 5,913,907 | * | 6/1999 | Lee | 70/57 X |
| 6,081,974 | | 7/2000 | McDaid | 24/265 CD |

OTHER PUBLICATIONS

"NoteLock Fastener" promotional material, Computer Security Products, Inc. web page, publication date unknown, at least as early as Jan. 6, 1998, http://www.computersecurity.com/etherlock/notelock.htm.

* cited by examiner

*Primary Examiner*—Suzanne Dino Barrett
(74) *Attorney, Agent, or Firm*—Kalow & Springut LLP

(57) ABSTRACT

A locking mechanism for securing personal portable valuables having a security or restraining slot comprises a generally hook-shaped restraining member having a moveable inner flange mounted in a housing, a shank section adapted to extend into the restraining slot of the portable device, and a hook section adapted to engage an inner surface of the exterior wall of the portable device through the restraining slot. A fastener is coupled through the housing for extending into an aperture in the inner flange when the restraining member is in the locked position to thereby inhibit movement of the restraining member to the installation, or unlocked, position and prevent removal of the locking mechanism from the portable device. Adhesive-backed locking mechanisms for portable valuables lacking a security slot also are described.

5 Claims, 28 Drawing Sheets

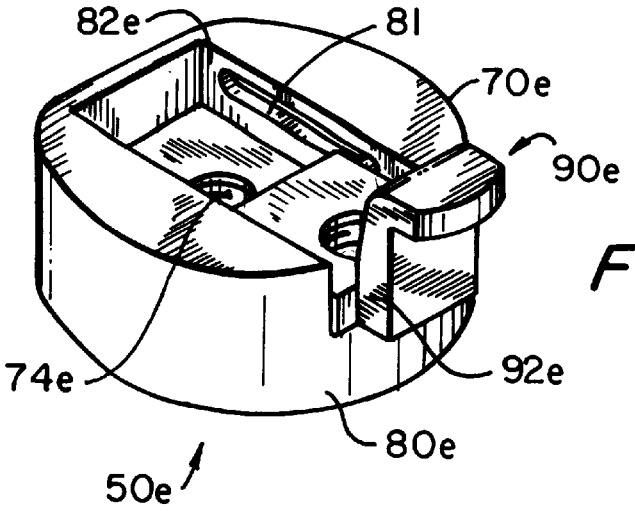
FIG. 22
FIG. 23
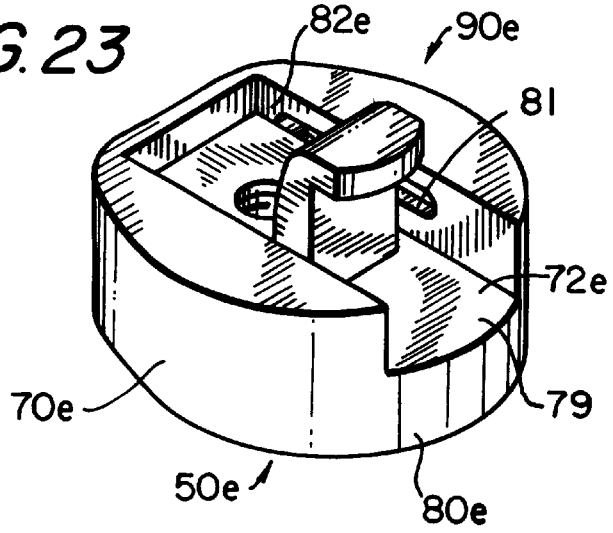
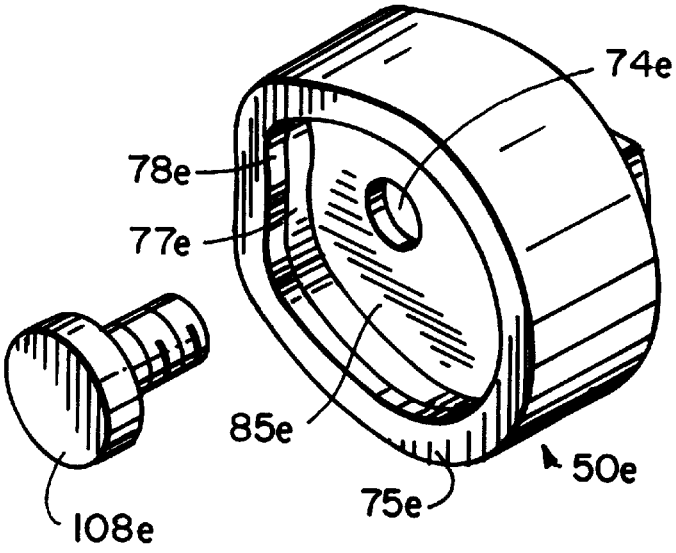
FIG. 24

FIG. 41
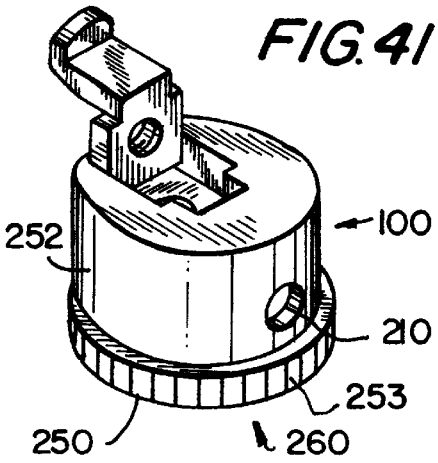
FIG. 42
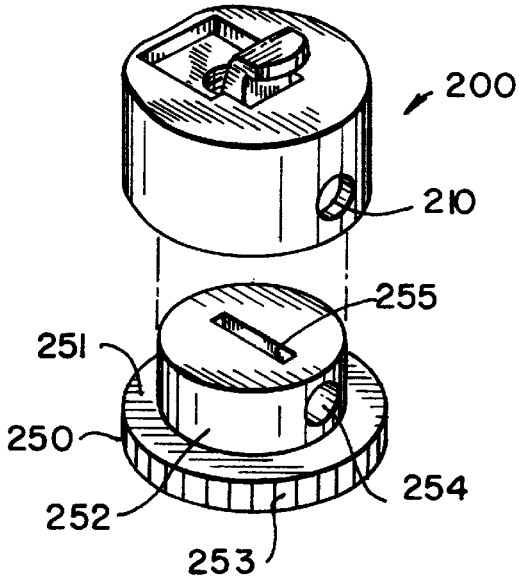
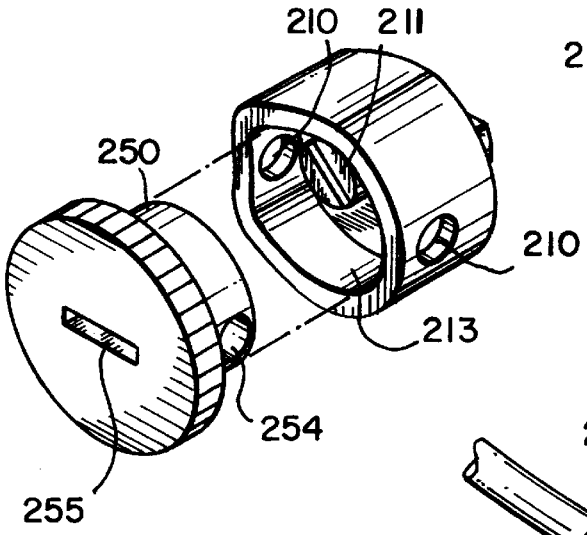
FIG. 43
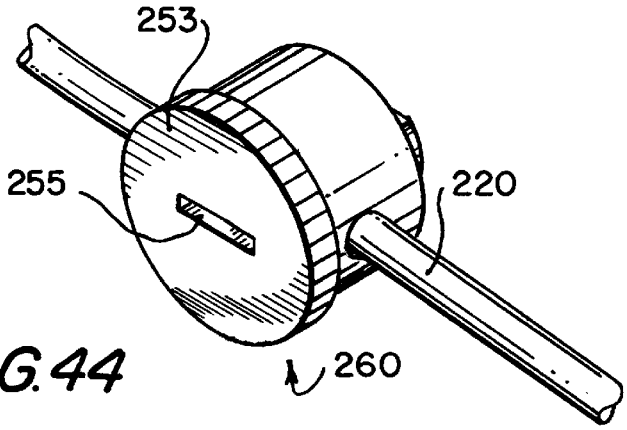
FIG. 44

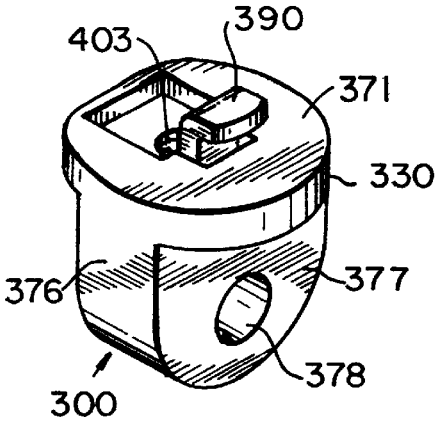
FIG. 45
FIG. 46
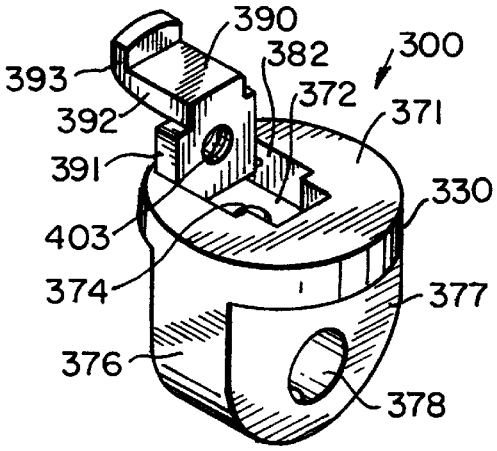
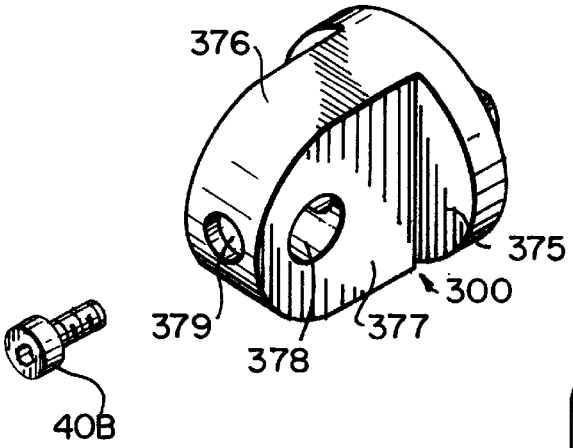
FIG. 47
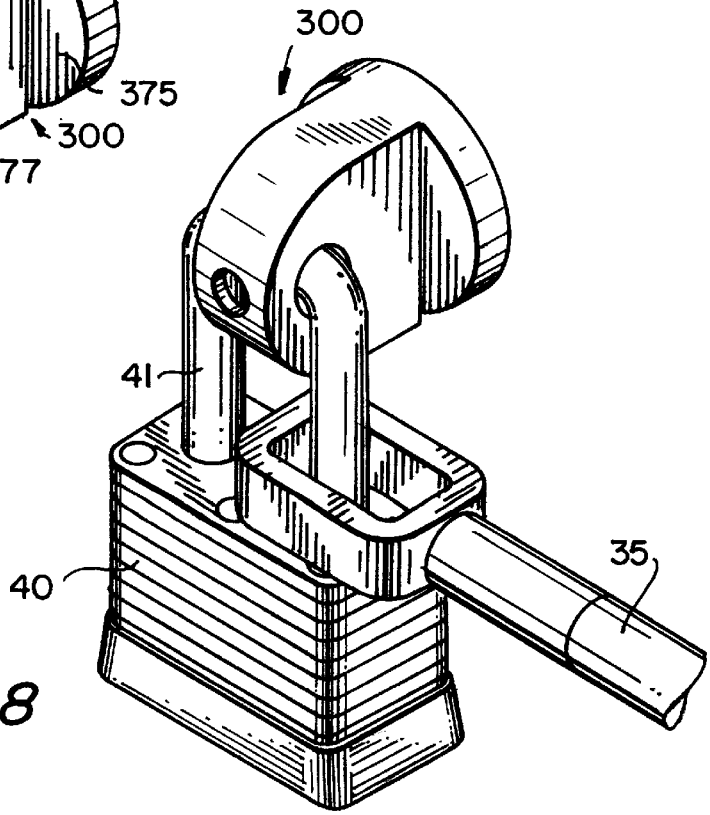
FIG. 48

440
416
414
410
415
412
451
413
400
411
450

LOCKING MECHANISM FOR PORTABLE VALUABLES

I. FIELD OF THE INVENTION

This invention relates to locking mechanisms for securing personal, portable valuables and, in particular, to locking mechanisms for securing notebook computers and other small but valuable electronic devices to relatively immovable objects for safekeeping.

II. BACKGROUND OF THE INVENTION

Computer designers over the past few decades have made extraordinary progress in miniaturizing computers. Electronic devices that once occupied rooms now can comfortably fit on the lap, or in the palm, of a user. An aspect of computers that has not changed quite so much is their cost. Small computers, particularly high performance notebook computers with large screens, are still quite expensive, and their value extends beyond the replacement cost of the computer to include data, lost productivity and reconstruction time.

The small size of notebook computers means that they can be carried by a person on business trips as a productivity enhancement tool. The natural result is that small and expensive notebook computers are often carried into public places, like airports and hotel lobbies, where the opportunity for theft is great. Also notebook computers often are left unattended in less public, but still relatively insecure, places such as offices, conference rooms, and hotel rooms.

The need to prevent theft of personal valuables extends beyond notebook computers to include theft prevention of other portable valuables such as palmtop computers, desktop computer monitors, keyboards and CPUs, personal stereos, music tape and CD players, and roller blades and other personal sporting equipment.

Theft prevention devices have been known in the art. One such scheme employs a security slot fabricated in the notebook computer into which a locking mechanism may be fitted. Typically, a cable is attached permanently or releasably to the locking mechanism. In operation, one end of the cable of the locking mechanism is looped around a chair arm, or some other large, relatively immoveable object, and then passed through a small closed loop in the other end of the cable. The cable is attached to the locking mechanism, if not already attached, and the locking mechanism is then locked to the security slot of the notebook computer. This arrangement prevents or deters theft of the notebook computer as it cannot be freed by passing it through the small cable loop when the locking mechanism is secured to the notebook computer.

Locking mechanisms for securing portable valuables are disclosed, for example, in U.S. Pat. Nos. 5,327,752, 5,493,878 and 5,502,989. Most of the locking mechanisms disclosed in these patents operate in a similar manner. They have a T-shaped crossing member at the distal end of a spindle which is inserted into the security slot, and then rotated. When rotated, the extensions of the T-shaped spindle engage against the inner surface of the wall surrounding the security slot thereby preventing removal of the locking mechanism from the personal, portable valuable.

One limitation of these devices is that the size of the extensions of the shank of the T-shaped spindle must be less than the longest dimension of the security slot so that they may be inserted into the security slot, and the diameter of the spindle must be less than the narrowest dimension of the security slot so that the spindle can rotate in the security slot. This results in relatively little surface contact between the extensions of the shank with the inner surface of the wall surrounding the security slot, and a relatively thin spindle. When forcibly tampered with, the inner wall of the portable valuable is subject to breaking due to large forces being spread over only a relatively small surface area. The spindle, because it has a relatively small diameter, is also subject to breaking during tampering.

The problems with these types of locking mechanisms are further compounded by the fact that in order to accommodate a variety of security slot depths, the length of the spindle exposed beyond the locking mechanism's housing to the cross member is often longer than the depth of the security slot. As a result a gap exits between the outer surface of the wall of the portable valuable and the facing surface of the locking mechanism housing. This gap provides ready access for insertion of, and leverage for, a tool to pry the locking mechanism from the portable device by breaking either the wall surrounding the security slot or the thin spindle.

Another drawback to these types of locking mechanisms is the T-shaped spindle must be inserted and withdrawn from the security slot each time the personal valuable is to be secured or moved. Due to the diminutive size of security slots, this is not always an easy task. Further, over time the repeated insertion and withdrawal of the spindle may cause abrasion and chipping of the sides of the security slot, leading to its enlargement.

Further, both the insertion and locking of these types of locking mechanisms, as well as their unlocking and withdrawal, require the use of a key. Requiring a key to insert and lock the locking mechanism can be an annoying inconvenience to the user, leading to times where the user can not be bothered to securely lock the portable valuable in place.

Thus it is desired to have a locking mechanism that has an extension member that has a larger surface area for engaging a larger surface area of the inner surface of the wall surrounding the security slot of the notebook computer and a thicker spindle or shank not limited in diameter or dimensions to the smallest dimension of the security slot, thereby increasing the strength and durability of the locking mechanism, and making the locking mechanism more theft-resistant.

It is also desired to have a locking mechanism that fits close to the external surface of a wide variety of personal, portable valuables so as to deter their being forcibly pried from the portable valuable.

Further desired is a locking mechanism for portable valuables that can be locked without a key.

III. SUMMARY OF THE INVENTION

Accordingly, it is an object of the present invention to provide a locking mechanism for securing personal, portable valuables to relatively immoveable objects for safekeeping.

It is another object of the present invention to provide a locking mechanism for securing portable valuables that has improved restraining properties over previous locking mechanisms.

It is a further object of the present invention to provide a locking mechanism for securing personal valuables that has a simple design with few moving parts.

It is yet another object of the present invention to provide a locking mechanism for securing portable valuables that is easy and inexpensive to manufacture and simple to install.

It is a yet further object of the present invention to provide a locking mechanism that easily and quickly locks without a key.

The foregoing objectives are accomplished by the present invention of a locking mechanism for attachment to a personal portable device having an exterior wall provided with a security or restraining slot of predetermined dimensions. The locking mechanism comprises a restraining member having an inner flange mounted in a housing, a shank section adapted to extend into the restraining slot of the portable device, and a hook section adapted to engage an inner surface of the exterior wall of the portable device through the restraining slot. The inner flange of the restraining member is adapted to move between an installation position and a locked position. A fastener is coupled through the housing for extending into an aperture in the inner flange when the restraining member is in the locked position to thereby inhibit movement of the restraining member to the installation, or unlocked, position and prevent removal of the locking mechanism from the portable device. A means for coupling the housing of the locking mechanism to an object other than the portable device also is provided to secure the portable device to the other object.

Generally, the housing of the locking mechanism has a face that, in the locked position faces the exterior wall of the portable device, a mounting cavity wherein the inner flange is mounted, and a face opposite the first face. The second, opposite, face has an aperture there through permitting the fastener to be insertible through the second face and into the mounting cavity to extend into the aperture in the inner flange and inhibit its movement.

In the locking mechanism the inner flange of the restraining member may be hinged, pivotally, slidably, rotatably or otherwise moveably mounted in the mounting cavity of the housing and is adapted to swing, pivot, slide, rotate or otherwise move between the installation position and the locked position. Any suitable arrangement of cooperating indents, recesses, holes, exdents, or pins fabricated in the restraining member and mounting cavity may be employed to moveably mount the restraining member in the mounting cavity of the locking mechanism. In preferred embodiments the interior walls of the mounting cavity are provided with a slot or opposing slots for mounting therein a pin or opposing pins extending from the inner flange of the restraining member.

The fastener useable in the present invention, is preferably adjustable and reversible, and may be any of a wide variety, including a bayonet or cam-style latch, a fractional-turn fastener, a compression or draw latch, a panel fastener, a plunge-head fastener, a pawl-action latch, or a screw or screw-type fastener. When the fastener is a screw, the aperture in the inner flange of the restraining member preferably is provided with a threaded portion complimentary to the threaded portion of the screw. The fastener is preferably captured in the housing of the locking mechanism, so as to prevent its misplacement or loss, by any suitable means, such as a clip-on receptacle or retainer, a snap-ring, a glue-on washer, a captive-screw or a captive-screw assembly.

The coupling means for coupling the housing of the locking mechanism to, and thereby secure the portable device to, an object other than the portable device, may comprise a lock receptacle for receiving and engaging a lock or a traverse aperture or opposite apertures to permit a securing device, such as a cable or a lock shackle, to extend through the locking mechanism.

Accordingly, the present invention provides a locking mechanism for attachment to a portable device having an exterior wall provided with a restraining slot of predetermined dimensions, comprising a housing having a first face for facing engagement with an exterior wall of the portable device, a receiving cavity for receiving a lock restraint, and a second face opposite said first face, with the receiving cavity having a opening through the second face and an inner surface adapted to engage the lock restraint. The locking mechanism also comprises a restraining member having an inner flange mounted in the housing, a shank section adapted to extend into the restraining slot of the portable device, and a hook section adapted to engage an inner surface of the exterior wall of the portable device through the restraining slot. The inner flange of the restraining member is adapted to move between an installation position and a locked position. A fastener is coupled through the housing for extending into an aperture in the inner flange when the restraining member is in the locked position to thereby inhibit movement of the restraining member to the installation, or unlocked, position and prevent removal of the locking mechanism from the portable device.

In an alternative embodiment, the locking mechanism housing may have a receiving cavity having an opening through the second face of the housing for receiving a lock restraint, and a flange extending outward from the second face which has a "mushroom-shaped" distal end for engaging the lock restraint.

The "mushroom-shaped" flange may be integrated with the fastener and, therefore, there is further provided by the present invention a locking mechanism for attachment to a portable device having an exterior wall provided with a restraining slot having predetermined dimensions, comprising a housing in which is mounted an inner flange of a restraining member adapted to move between an installation position and a locked position, and having a shank section adapted to extend into the restraining slot of the portable device, and a hook section adapted to engage the inner surface of the exterior wall of the portable device through its restraining slot. A fastener is coupled through the housing with one end adapted for extending into an aperture in the inner flange when the restraining member is in the locked position to thereby inhibit movement of the restraining member to the installation position, and a "mushroom-shaped" end having an inner surface adapted for engaging a lock restraint to thereby couple the locking mechanism to a device other than the portable device.

As aforementioned, the coupling means of the locking mechanism of the present invention also preferably may comprise a traverse aperture or opposite apertures which permit a cable, or lock shackle, or other securing device to extend there through and thus couple the housing of the locking mechanism to another object. Therefore, a locking mechanism for attachment to a portable device having an exterior wall provided with a restraining slot having predetermined dimensions is provided by the present invention which mechanism comprises a housing having a face for facing engagement with the exterior wall of a portable device, a mounting cavity, a securing cavity having opposing apertures there through and a connecting aperture through to said mounting cavity, and an opposite second face having an opening therein. A restraining member is provided having an inner flange mounted in the mounting cavity and adapted to move between an installation position and a locked position, a shank section adapted to extend into the restraining slot of the portable device, and a hook section adapted to engage an inner surface of the exterior wall of the portable device through the restraining slot. A fastener that is insertible through the opening in the second face and through the connecting aperture and extends into an aperture in the inner flange when the restraining member is in the locked position inhibits movement of the restraining member to the installation position. In this embodiment the opposing apertures permit a securing device to couple the locking mechanism to another object.

One preferred embodiment of a locking mechanism employing apertures as a coupling means is one whose housing includes an outward extending flange with a traverse aperture in the flange which serves to couple the locking mechanism to another object by permitting a securing device to extend through the flange. Further preferred in this embodiment is that the outward extending flange have an axial aperture there through permitting the fastener to be insertible through the outward extending flange and into the mounting cavity thereby to extend into the aperture in the inner flange.

The opposite apertures also may be provided, in a preferred embodiment, in sidewalls of the locking mechanism housing substantially orthogonal to the second face. Included with this embodiment may be a security spindle to restrict access to the fastener of the locking mechanism once it is in its locked position. The security spindle is adapted for insertion into the cavity defined by the housing sidewalls and has a traverse aperture collinear with the opposing apertures in the housing sidewalls to permit a security device to extend through the housing and the spindle.

One embodiment of the present invention is a locking mechanism comprising a housing with a generally flat surface for facing engagement with a surface of the portable, personal valuable to be secured. Rotatably mounted within the housing is a restraining member for engaging a security slot fabricated in the portable valuable. The restraining member of the locking mechanism is generally hook-shaped, comprising an upper flange, a shank, and a hook member. Fabricated in the surface of the housing of the locking mechanism that is in facing engagement with the portable valuable is a recessed mounting cavity. The upper flange of the restraining member is shaped to conform to this recessed cavity. Two pins extend outward from the upper flange of the restraining member to engage mounting holes fabricated in the sides of the recessed cavity, thereby permitting rotational movement of the restraining member between two positions; an installation position and a locking position. In the installation position the restraining member generally extends outward from the housing. During installation the distal end of the hook member is inserted into the security slot of the portable valuable, with the shank of the restraining member being generally parallel to the surface of the portable valuable at the initial installation position. The restraining member is then rotated and laterally translated to insert the shank and hook member into the slot. In the locking position, the flange of the restraining member is initially in facing engagement with the surface of the portable valuable adjacent to the security slot. Fabricated in the flange is an aperture or screw hole that aligns with a similar aperture or through hole in the housing. In the final installation step, the housing is rotated down onto the restraining member so that the recessed cavity accepts the flange of the restraining member. A screw fastener mounted in the through hole of the housing is then rotated to engage the screw hole in the flange of the restraining member. The shank of the restraining member is sized to accommodate a range of security slot depths. In a particularly shallow security slot, as the screw is tightened into final locking position, the flange would extend below the outer surface of the housing in facing engagement with the portable valuable, leaving the housing of the locking device in facing engagement with the mounting surface of the portable valuable.

An alternative embodiment of the present invention is a locking mechanism comprising a housing with a generally flat surface for facing engagement with a surface of a portable valuable to be secured. The housing is cylindrical in shape. Fabricated in the surface of the housing intended to be in facing engagement with the portable valuable is a recessed cavity. A portion of this mounting cavity extends through the side of the cylindrical housing. Slidably and rotatably mounted within the recessed cavity of the housing is a restraining member. The restraining member of the locking mechanism is generally hook-shaped, comprising an upper flange, a shank, and a hook member. The upper flange of the restraining member is shaped to conform to this recessed cavity. Two pins extend outward from opposite sides of the upper flange, and are intended for mounting in slots fabricated in the sides of the recessed cavity. When mounted in the slots, the combination of the slots and the pins permit both rotational and translational movement of the restraining member. The restraining member is moveable between at least two positions, an installation position and a locking position. In the installation position, the restraining member is slidably translated so that the shank roughly aligns with the outer cylindrical surface of the housing of the locking mechanism. The shank of the restraining member is generally parallel to the surface of the portable valuable containing the security slot. A distal end of the hook member of the restraining member is inserted into the security slot. The restraining member is then rotated and laterally translated to insert the shank and hook member into the slot. In the locking position, the flange of the restraining member is initially in facing engagement with the surface of the portable valuable adjacent to the security slot. Fabricated in the flange is a screw hole aperture that aligns with a similar screw hole aperture in the housing. In the final installation step, the housing is rotated down onto the restraining member so that the recessed cavity accepts the flange of the restraining member. The shank of the restraining member is sized to accommodate a range of security slot depths. This means that as the screw is tightened into final locking position in a security slot having a relatively shallow slot depth, the flange would extend below the outer surface of the housing in facing engagement with the portable valuable, leaving the housing of the locking device in facing engagement with the mounting surface of the portable valuable.

Another alternative embodiment of the present invention is a locking mechanism comprising a housing with a generally flat surface for facing engagement with a surface of the portable valuable to be secured. The housing of the locking mechanism is generally cylindrical in shape. Fabricated in the surface of the housing intended to be in facing engagement with the portable valuable is a recessed mounting cavity. The recessed cavity has a generally circular shape. A portion of this cavity extends through the side of the cylindrical housing, leaving an opening in the side of the cylindrical housing. Rotatably mounted within the recessed cavity of the housing is a restraining member. The restraining member of the locking mechanism is generally hook-shaped, comprising an upper flange, a shank and a hook member. Fabricated in the sides of the circular recessed cavity is a groove. Fabricated on opposite sides of the upper flange of the restraining member are pins. When the pins are mounted in the groove, they permit circular rotation of the restraining member in a plane generally parallel to the surface of the housing intended for facing engagement with the portable valuable. The restraining member is rotatable between at least two positions, an installation position and a locking position. In the installation process, the restraining member is rotated into the installation position, where the shank of the restraining member generally aligns with the outer cylindrical surface of the housing. In the installation position, the shank of the restraining member is generally parallel to the surface of the portable valuable containing the security slot. A distal end of the hook member of the restraining member is inserted into the security slot. The restraining member is then rotated and laterally translated to insert the shank and hook member into the slot. A screw hole is fabricated in the upper flange of the restraining member. A similar screw hole is fabricated in the housing extending into the recessed cavity. A screw is inserted into the screw-hole of the cavity. In the last installation step, the housing is rotated while the restraining member remains fixed in its position in the security slot. The rotation of the housing brings the screw hole in the housing into alignment with the screw hole of the upper flange. The screw is then tightened, causing it to engage the threaded screw hole in the upper flange, and thereby locking the restraining member and housing in a fixed, locked position with respect to the portable valuable.

A further alternative embodiment is a locking mechanism comprising a housing with a generally flat surface for facing engagement with a surface of the portable valuable to be secured. The housing is cylindrical in shape. Fabricated in the surface of the housing intended to be in facing engagement with portable valuable is a mounting cavity. Located within the recessed cavity is a restraining member and worm gear tightening mechanism. The restraining member is generally hook-shaped and comprises a hook member, shank section, and an upper worm gear portion. Mounted within the housing is a worm screw immediately adjacent to the restraining member for engaging the worm gear of the restraining member. Located on opposite sides of the restraining member near the worm gear are flanges having partially circular, and partially rectangular cross sections. These flanges are inserted into cavities having bearing surfaces permitting initial rotational movement, followed by translational movement. In the first step of the installation process, a distal end of the hook member is inserted into the security slot. The hook member and shank are then rotated and linearly translated into the security slot. At the end of this initial step of the installation process the housing surface intended to be in facing engagement with mounting surface of the portable valuable is generally orthogonal to this mounting surface. In the next step of the installation process, the worm screw is tightened, causing initial rotational movement of the housing to bring the surface of the housing intended to be in facing engagement with the mounting surface of the portable valuable into a position where the plane of the mounting surface and the plane of the surface of the housing are parallel to one another. Further tightening of the worm screw causes linear translation of the housing, bringing the housing into facing engagement with the mounting surface of the portable valuable.

In embodiments of the present invention, a cable lock attaches to, or is integrated with, the locking mechanism installed on the portable valuable. In alternative embodiments, the cable of a cable lock, or the shackle of a lock, or other securing device, passes through an aperture or apertures in the cylindrical housing of the locking mechanism to prevent removal of the locking mechanism from the portable valuable.

The present invention provides locking mechanisms to aid in preventing the theft of portable, personal valuables, such as notebook computers, having an external wall provided with a small (the industry standard presently being about 3 by 7 millimeter) approximately rectangular security or restraining slot. This small security slot is now being routinely fabricated into notebook computers and other portable valuables.

For portable valuables lacking a security slot, the present invention also provides locking mechanisms designed to be directly attached to an external surface of the portable valuable thereby providing mechanisms by which the personal valuable may be secured to a relatively immovable object. A lock receptacle that adhesively attaches to the portable valuable allows cable locks to be used with a portable device lacking a security slot. The lock receptacle has an attachment plate that is generally flat with a bottom surface coated with an adhesive. The adhesive adheres the attachment plate to the portable valuable. Extending outward from the center of the attachment plate is a cylindrical flange fabricated to provide a receptacle for the insertion and engagement of a lock or other securing device.

Thus, the present invention further provides a preferred embodiment of a locking mechanism for attachment to a portable device comprising a flat plate having a bottom adhesive surface for attaching the plate to an exterior wall of the portable device, an upper surface, and a spindle extending outward from the upper surface and having a "mushroom-shaped" distal end having an inner surface adapted for engaging a lock restraint.

From the description above, a number of advantages of the present invention become evident. First, the locking mechanism of the invention comprises a simple structure that is inexpensive to manufacture and install, but which provides a secure locking function for the peace of mind of owners of portable, personal valuables. In particular, the hooking member of the locking mechanism provides a greater surface with which to contact the interior surface of the wall surrounding the security slot in which the locking mechanism is mounted. In addition, the adjustable nature of the combination of the restraining member and housing which compensates for varying slot dimensions provides a locking mechanism that fits snug against the exterior surface of a portable valuable and is particularly resistant to tampering.

Additional advantages of the preferred embodiments of the present invention include the provision of an easy to use lock receptacle on a portable device that need not be removed each time the valuable is to be moved and that may readily engage a variety of locks, including ones that can be locked without a key.

IV. BRIEF DESCRIPTION OF THE DRAWINGS

The above and other objects and advantages of this invention will be apparent upon consideration of the following detailed description, taken in conjunction with the accompanying drawings in which like characters refer to like parts throughout and in which.

Figure 9:
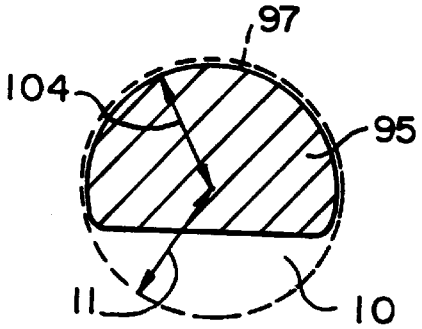
Figure 5:
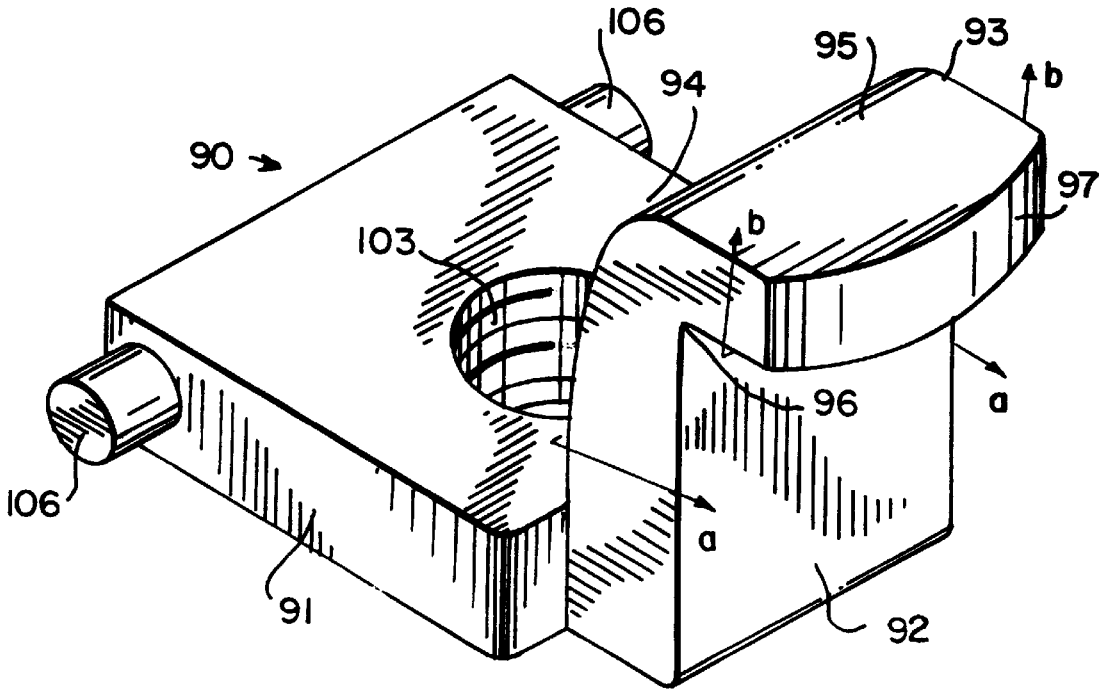
FIG. 5 is a top isometric view of a restraining member of the first preferred embodiment of the present invention.
Figure 8A:
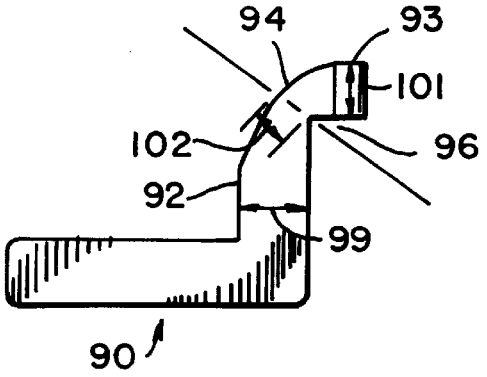
Figure 8B:
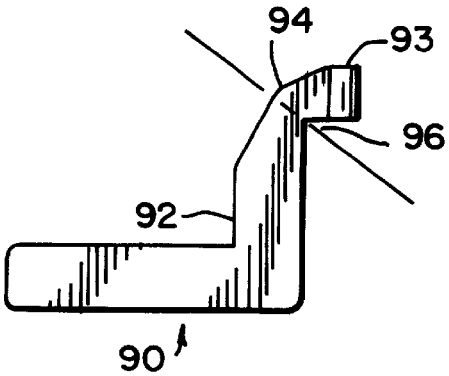
Figure 8C:
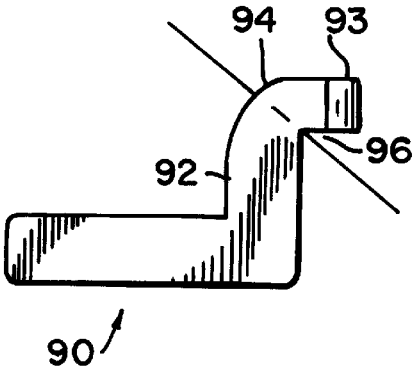
Figure 11:
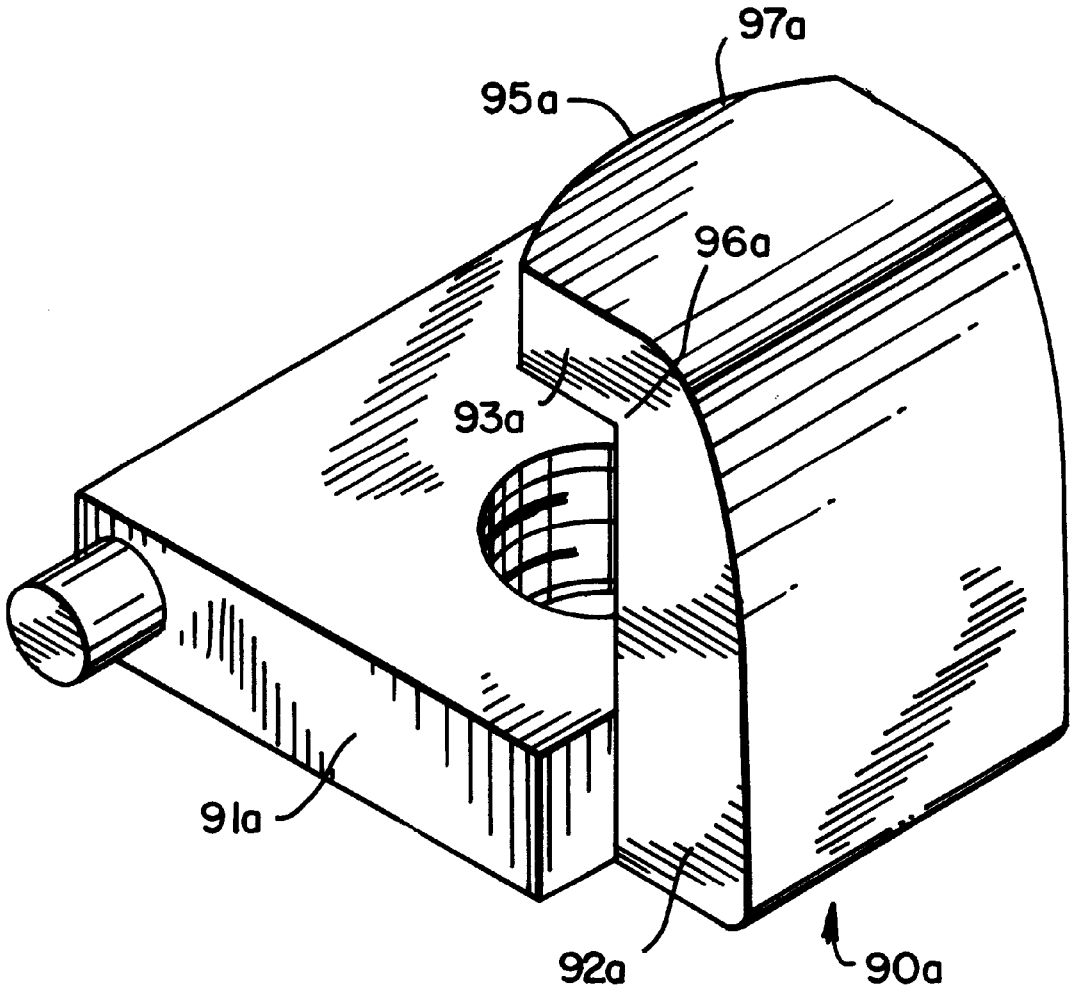
Figure 12A:
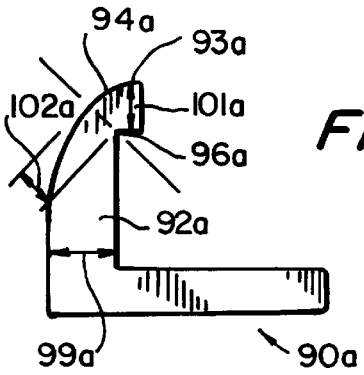
Figure 12B:
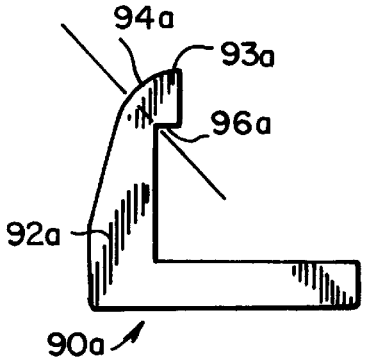
Figure 12C:
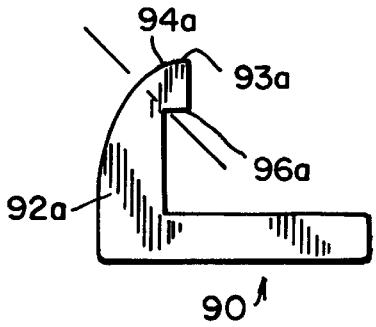
Figure 14:
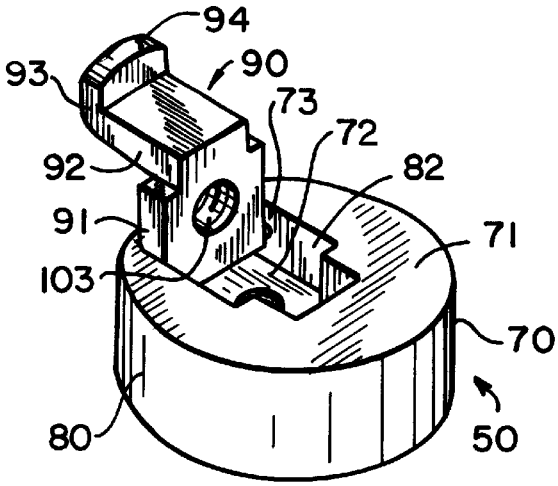
Figure 15:
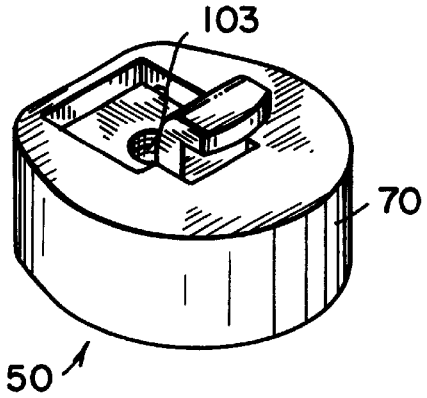
Figure 16:
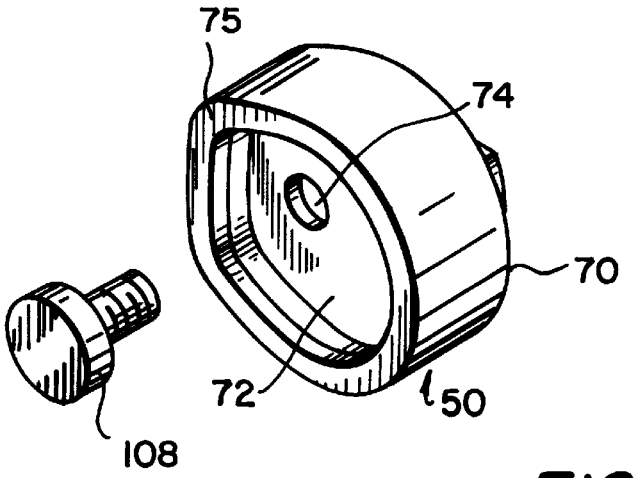
Figure 17A:
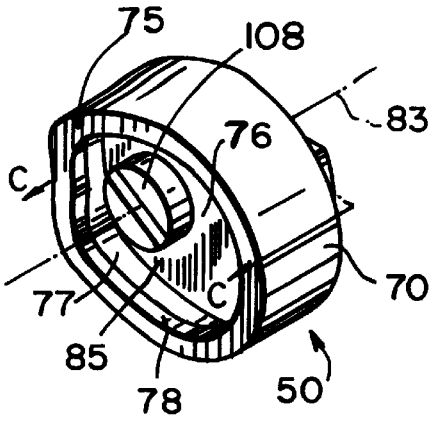
Figure 17B:
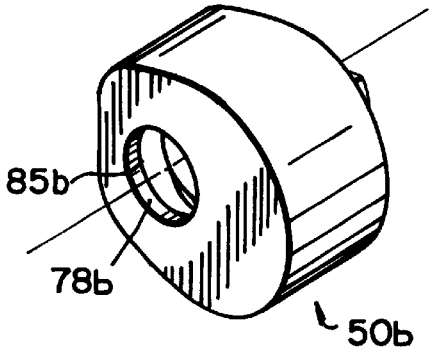
Figure 17C:
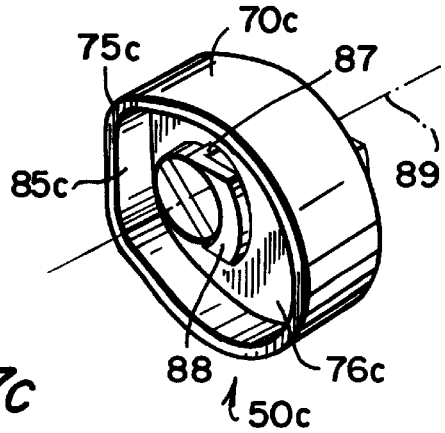
Figure 17D:
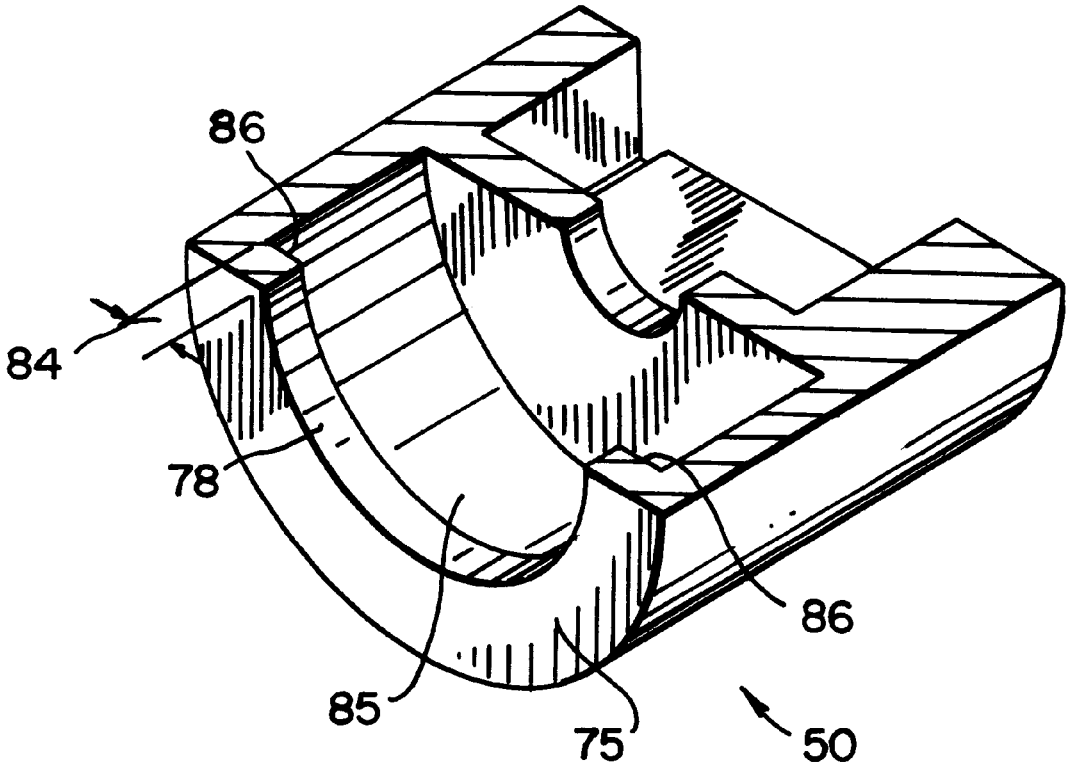

FIGS. 8*a–c* are schematic views showing restraining members for embodiments of the present invention;

FIG. 9 is a fragmentary elevation view of the distal end of a restraining member for an embodiment of the present invention in a security slot in a portable valuable;

FIGS. 10*a–e* are schematic views showing the theory of operation of a locking mechanism using the restraining member of FIG. 5 made in accordance with the invention;

FIG. 11 is a top isometric view of a restraining member of alternative preferred embodiments of the present invention;

FIGS. 12*a–c* are schematic views showing restraining members for embodiments of the sent invention;

FIGS. 13*a–d* are schematic views showing the theory of operation of a locking mechanism using the restraining member of FIG. 11 made in accordance with the invention;

FIG. 14 is a top isometric view of a first preferred embodiment of a locking mechanism for portable valuables, depicting the restraining member of the locking mechanism in installation position;

FIG. 15 is a top isometric view of a first preferred embodiment of a locking mechanism for portable valuables, depicting the restraining member of the locking mechanism in a locking position;

FIG. 16 is a bottom isometric view of a first preferred embodiment of a locking mechanism, depicting the captive screw and screw hole in the housing of the locking mechanism;

FIGS. 17*a–c* are bottom isometric views of lock receptacles of locking mechanisms of the resent invention;

FIG. 17*d* is a cross-sectional, top isometric view taken along line c—c of FIG. 17*a*.

Figure 19:
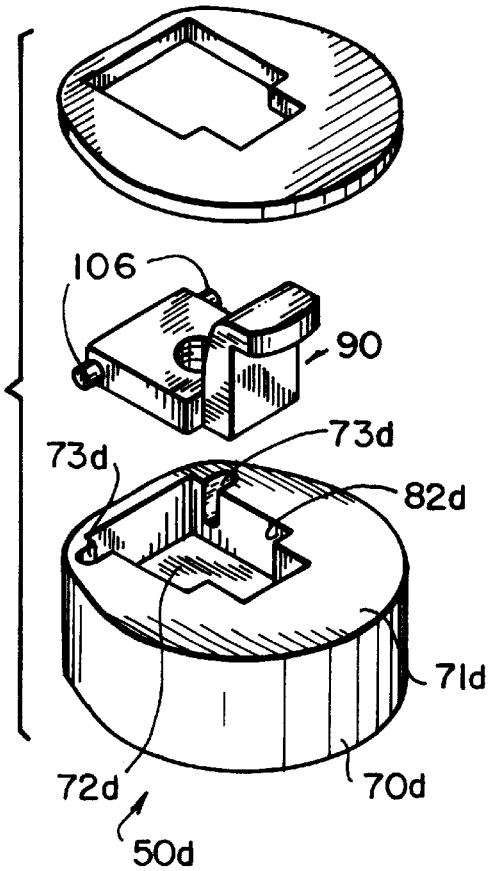
Figure 21:
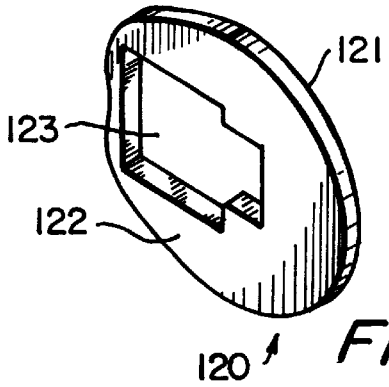
Figure 20:
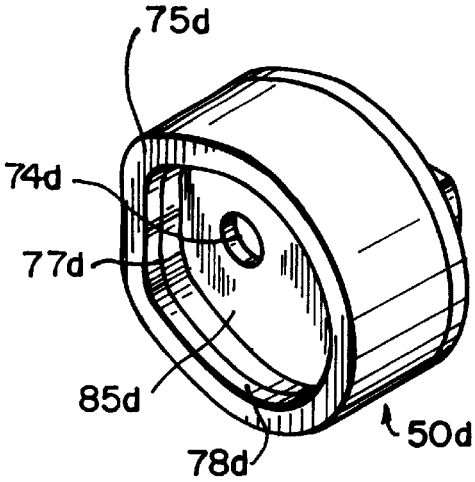
Figure 18:
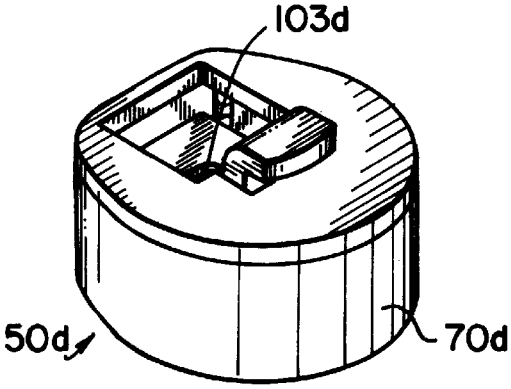
Figure 25A:
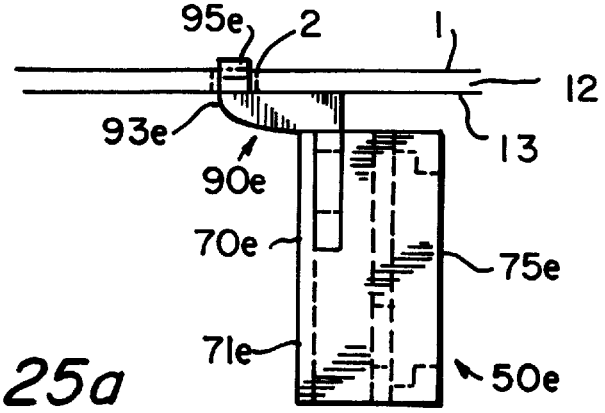
Figure 25B:
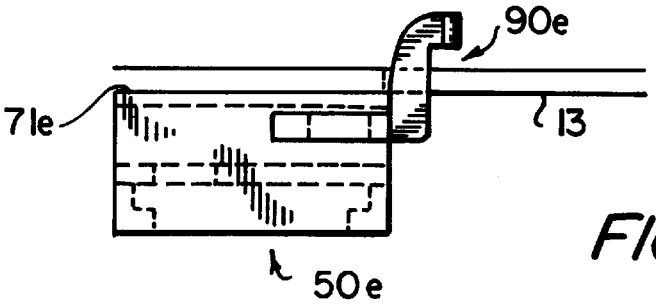
Figure 25C:
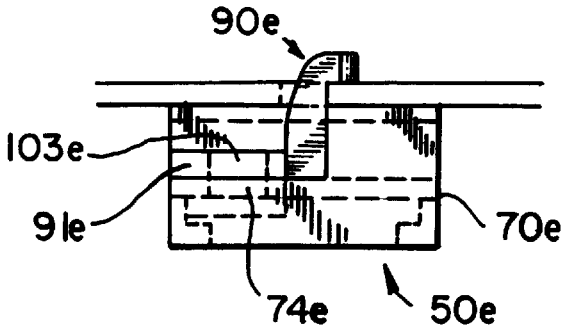
Figure 26:
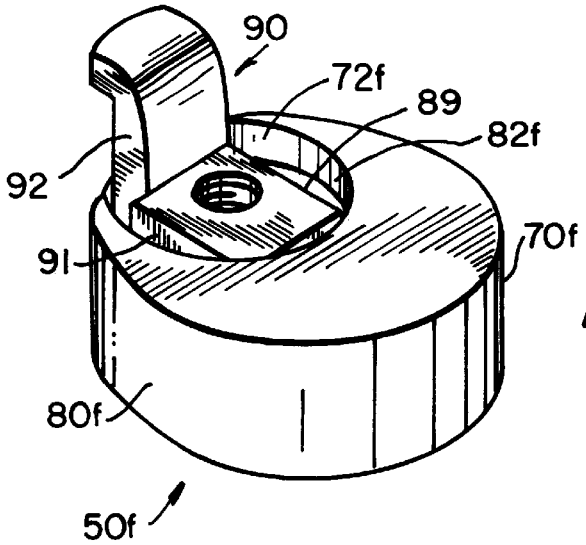
Figure 27:
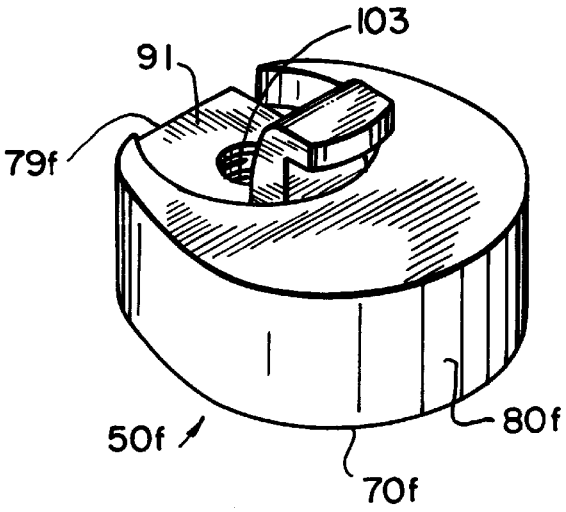
Figure 28:
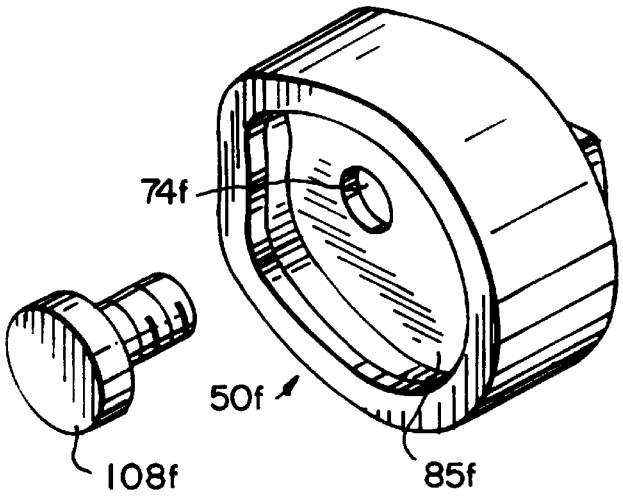
Figure 29:
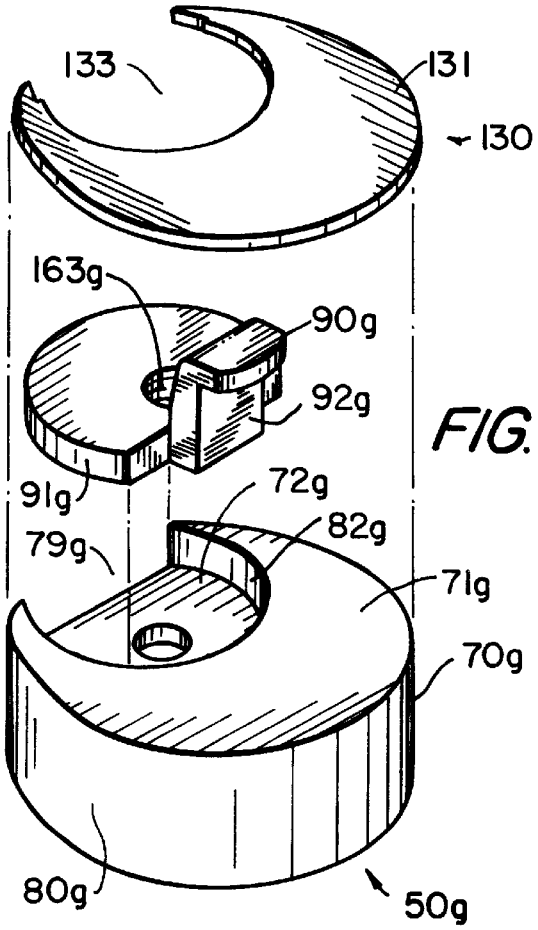
Figure 32:
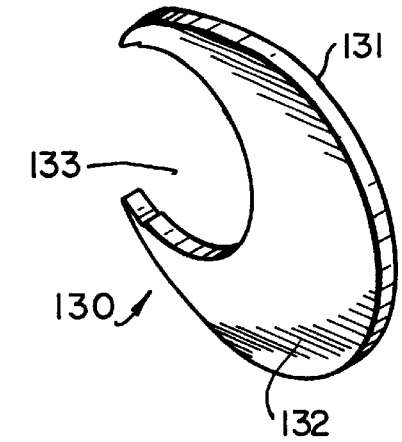
Figure 31:
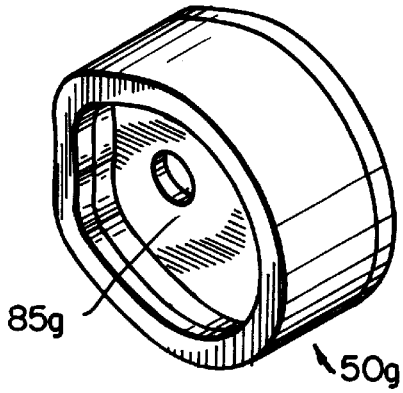
Figure 30:
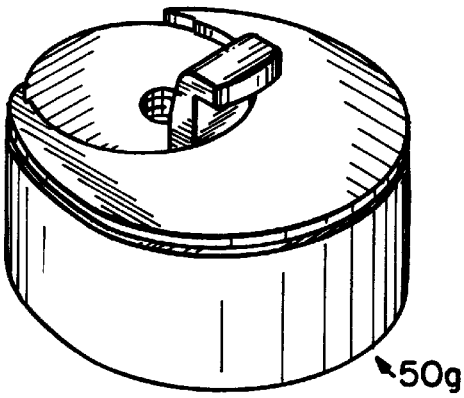
Figure 33A:
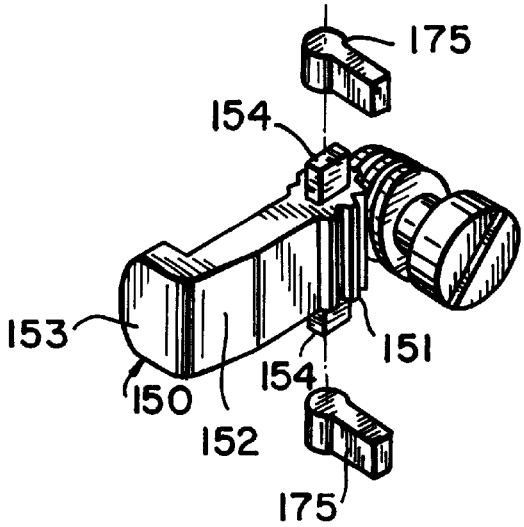
Figure 33B:
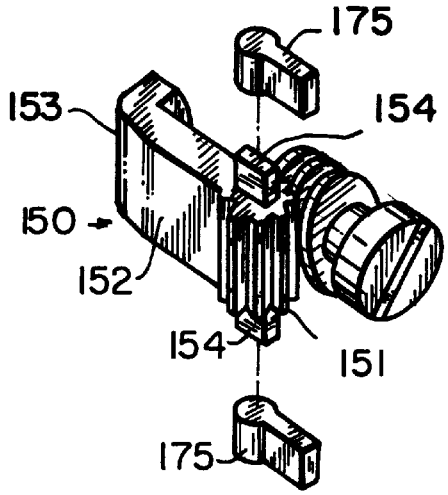
Figure 33C:
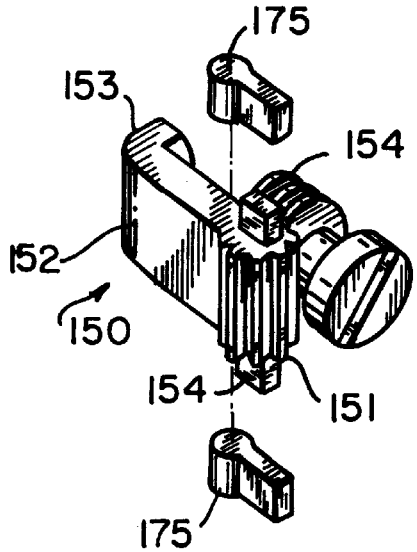
Figure 34:
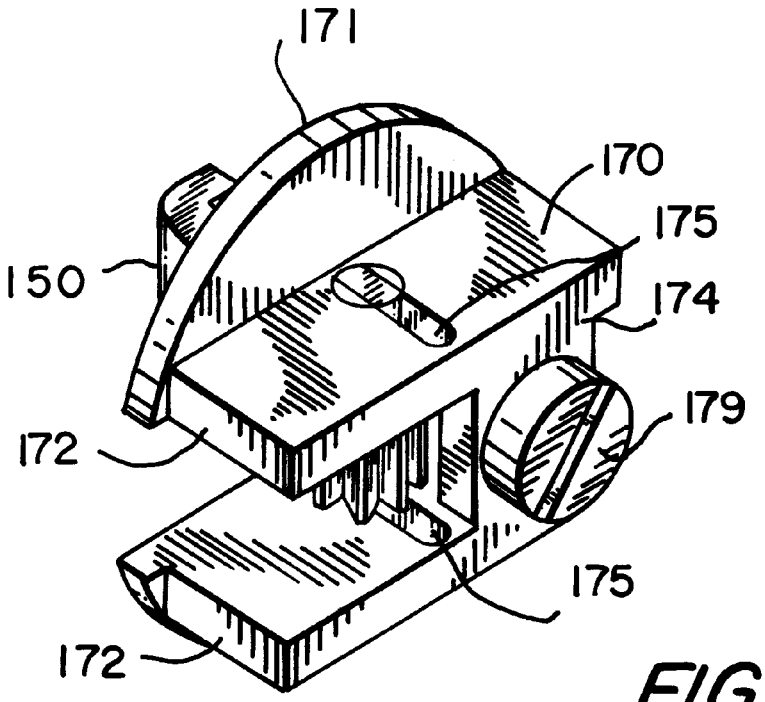
Figure 35:
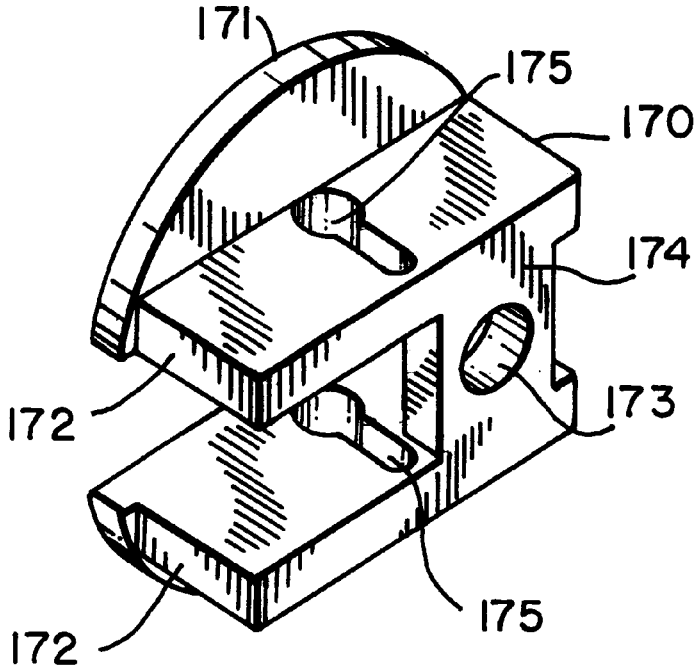
Figure 36:
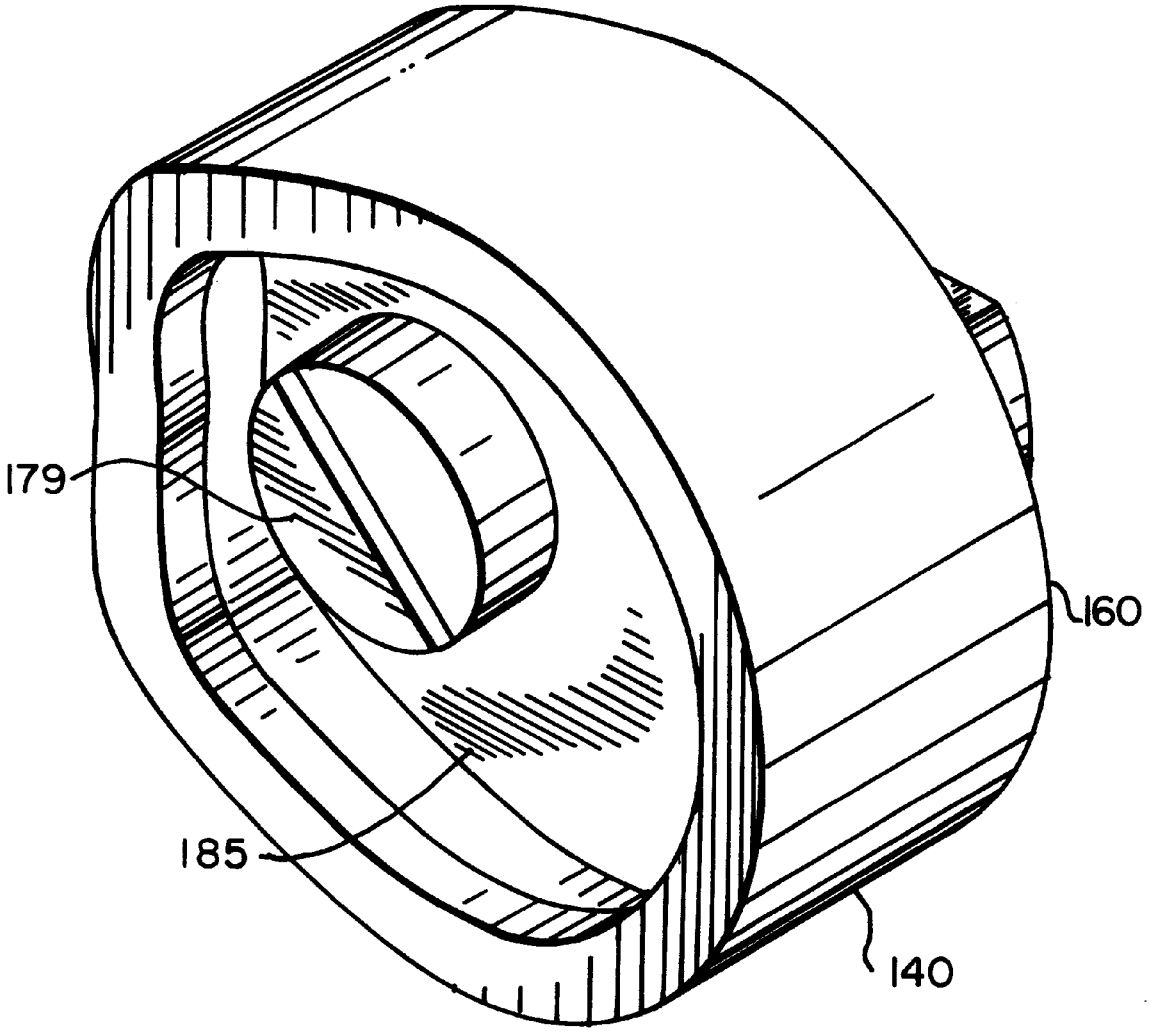
Figure 37:
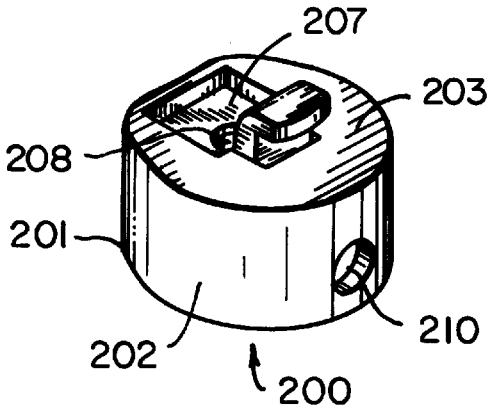
Figure 38:
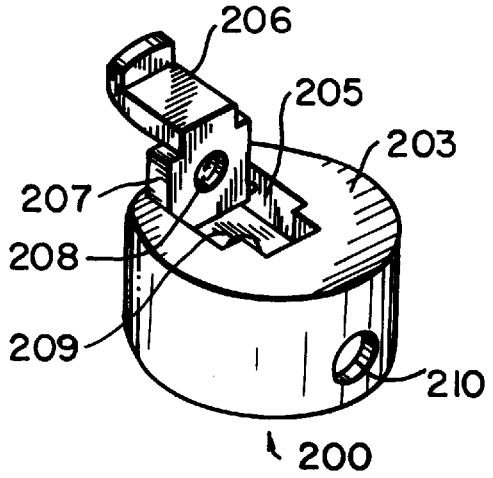
Figure 39:
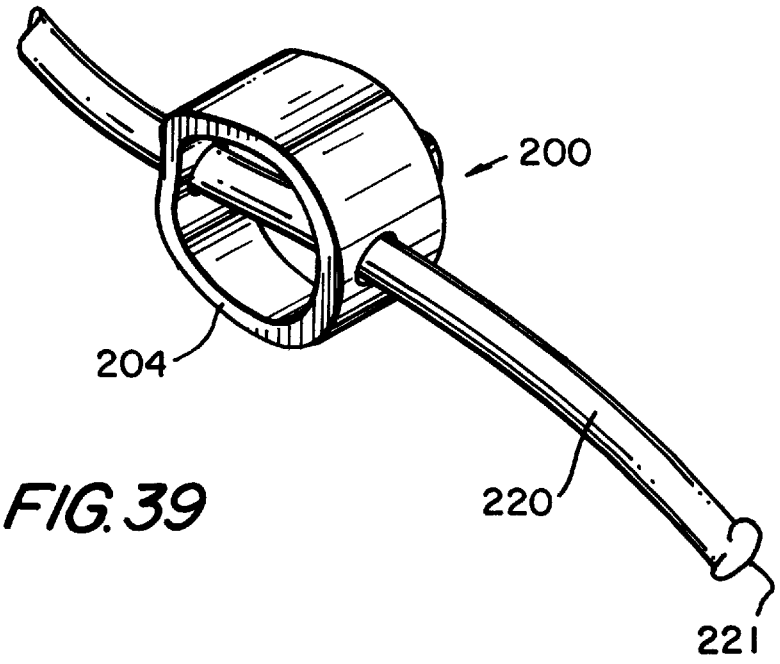
Figure 40:
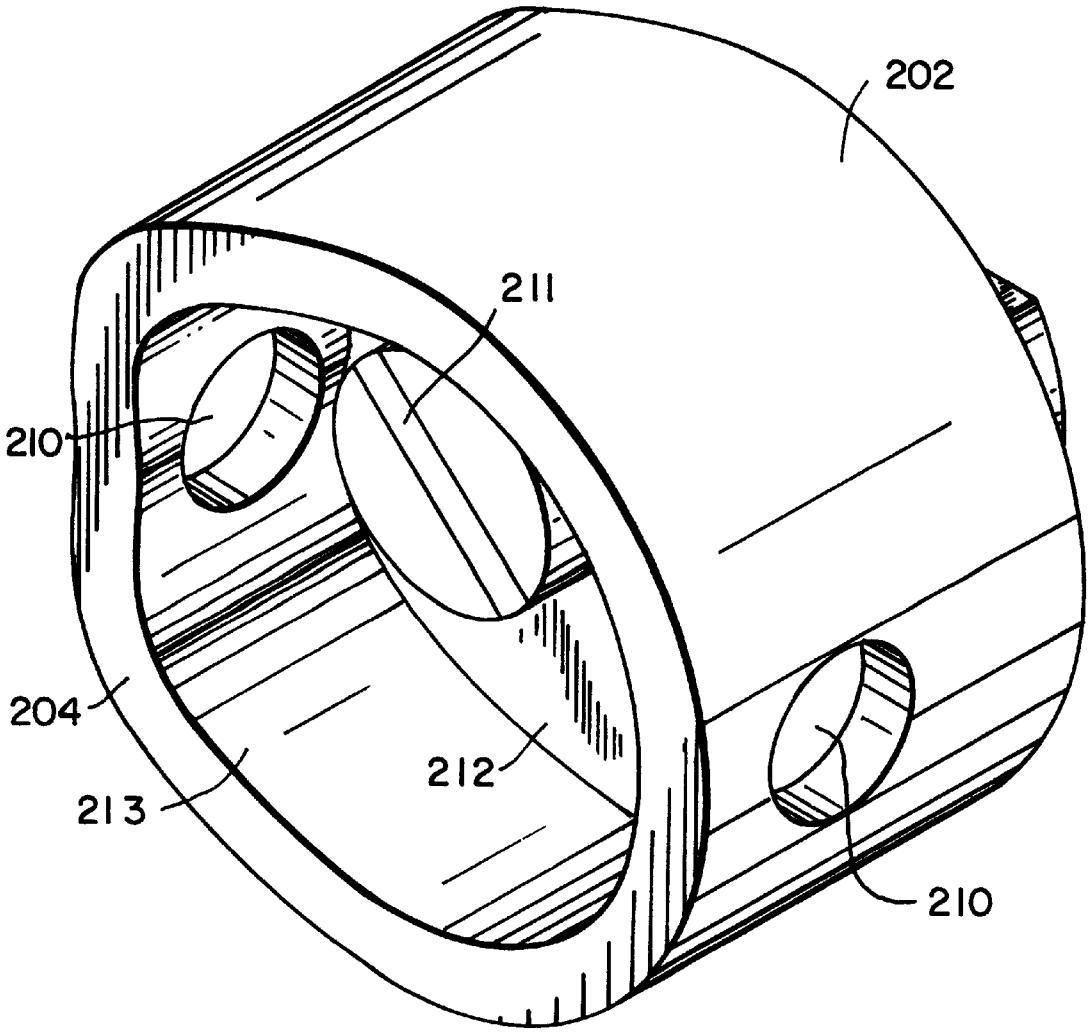
Figure 49:
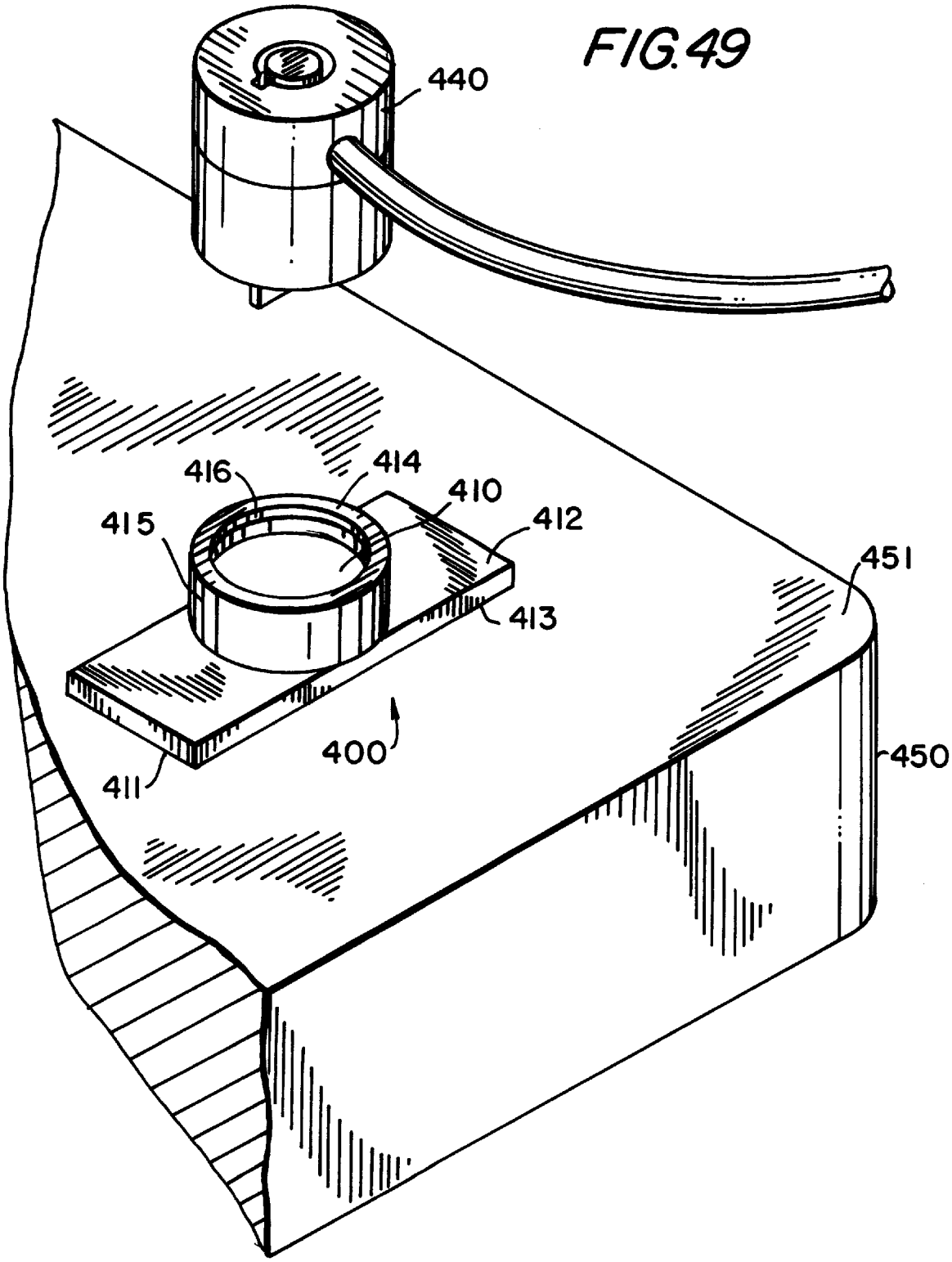
Figure 50A:
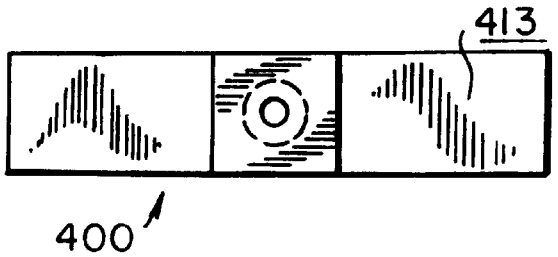
Figure 51:
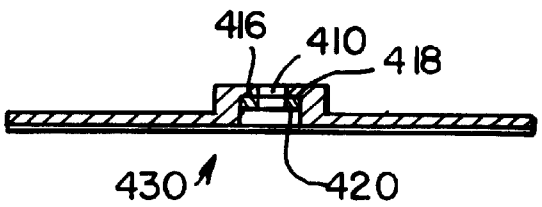
Figure 50B:
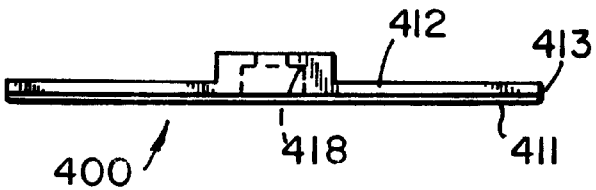
Figure 50C:
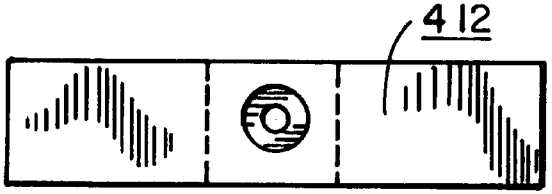
Figure 50D:
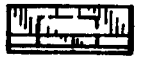
Figure 50E:
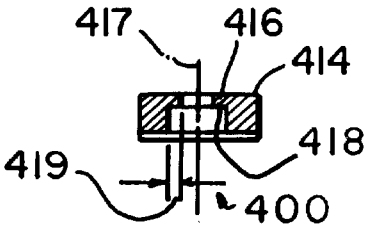
Figure 52A:
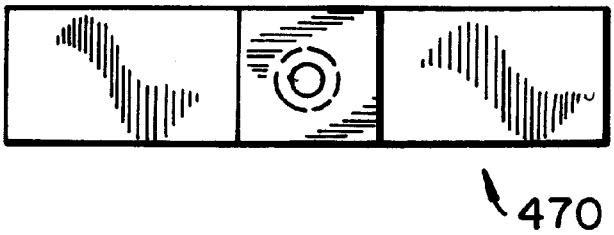
Figure 52B:
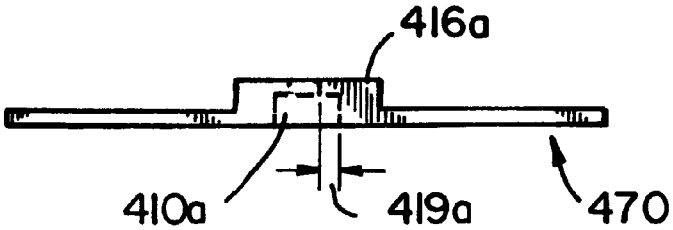
Figure 53A:
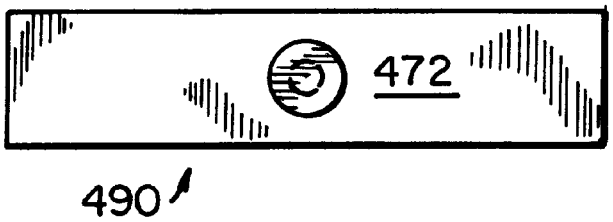
Figure 53B:
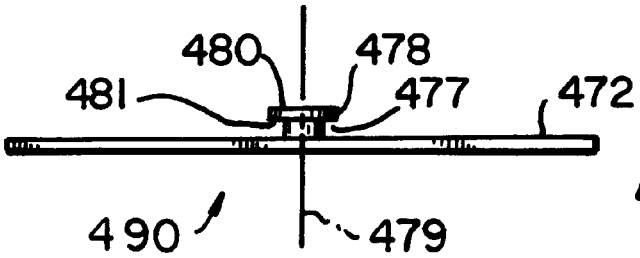

FIG. 18 is a top isometric view of a second preferred embodiment of a locking mechanism for portable valuables, depicting the restraining member of the locking mechanism in an installation position;

FIG. 19 is a top isometric view of a second preferred embodiment of a locking mechanism for portable valuables, depicting the restraining member of the locking mechanism in a locking position;

FIG. 20 is a bottom isometric view of a second preferred embodiment of a locking mechanism for portable valuables;

FIG. 21 is a bottom isometric view of a cover for a second preferred embodiment of a locking mechanism for personal valuables;

FIG. 22 is a top isometric view of a third preferred embodiment of a locking mechanism for portable valuables, depicting the restraining member of the locking mechanism in an installation position;

FIG. 23 is a top isometric view of a third preferred embodiment of a locking mechanism for portable valuables, depicting the restraining member of the locking mechanism in a locked position;

FIG. 24 is a bottom isometric view of a third preferred embodiment of a locking mechanism for portable valuables;

FIGS. 25*a–c* are schematic views of the third preferred embodiment depicting the theory of operation of this locking mechanism;

FIG. 26 is a top isometric view of a fourth preferred embodiment of a locking mechanism for portable valuables, depicting the restraining member of the locking mechanism in an installation position;

FIG. 27 is a top isometric view of a fourth preferred embodiment of a locking mechanism for portable valuables, depicting the restraining member of the locking mechanism a locking position;

FIG. 28 is a bottom isometric view of a fourth preferred embodiment of a locking mechanism for portable valuables;

FIG. 29 is a top isometric view of a fifth preferred embodiment of a locking mechanism for portable valuables, depicting the restraining member of the locking mechanism in an installation position;

FIG. 30 is a top isometric view of a fifth preferred embodiment of a locking mechanism for portable valuables, depicting the restraining member of the locking mechanism in a locking position;

FIG. 31 is a bottom isometric view of a fifth preferred embodiment of a locking mechanism for portable valuables;

FIG. 32 is a bottom isometric view of a cover for a fifth preferred embodiment of a locking mechanism for personal valuables;

FIGS. 33*a–c* are schematic views of a sixth preferred embodiment of a locking mechanism for portable valuables showing the theory of operation of this embodiment;

FIG. 34 is a schematic view of a sixth preferred embodiment of a locking mechanism for portable valuables depicting the bearing structure of the locking mechanism;

FIG. 35 a schematic view of a sixth preferred embodiment of a locking mechanism for locking portable valuables depicting the bearing surfaces of the locking mechanism;

FIG. 36 is a bottom isometric view of a sixth preferred embodiment of a locking mechanism for portable valuables depicting the housing of the locking mechanism;

FIG. 37 is a top isometric view of a preferred embodiment of a locking mechanism of the present invention in an unlocked position;

FIG. 38 is a top isometric view of a preferred embodiment of a locking mechanism of the present invention in a locked position;

FIG. 39 is a bottom isometric view of the preferred embodiment of FIGS. 37 and 38 illustrating its use with a cable;

FIG. 40 is a bottom isometric view of the preferred embodiment of FIGS. 37 and 38;

FIG. 41 is a top isometric view of an embodiment of a locking mechanism of the present invention assembled with a security spindle ready for use in securing a portable valuable;

FIG. 42 is an exploded top isometric view of the locking mechanism of FIG. 41;

FIG. 43 is an exploded bottom isometric view of the locking mechanism of FIG. 41;

FIG. 44 is a bottom isometric view of the embodiment of FIG. 41 illustrating its use with a cable;

FIG. 45 is a top isometric view of a preferred embodiment of a locking mechanism of the present invention in a locked position;

FIG. 46 is a top isometric view of a preferred embodiment of a locking mechanism of the present invention in an unlocked position;

FIG. 47 is a bottom isometric view of the preferred embodiment of FIGS. 45 and 46;

FIG. 48 is a bottom isometric view of the preferred embodiment of FIGS. 45 and 46 illustrating its use with a shackle of a lock;

FIG. 49 is an isometric view of a locking mechanism of the present invention adhered to the surface of a portable valuable;

FIGS. 50*a–e* are top, side, bottom and end view drawings of the locking mechanism of FIG. 49;

FIG. 51 is a side view drawing showing a modified locking mechanism of FIGS. 49 and 50;

FIGS. 52*a–b* are top and side view drawings of an alternative embodiment of the locking mechanism of FIGS. 49 and 50;

FIGS. 53*a–b* are top and side view drawings of another alternative embodiment of the locking mechanism of FIGS. 33 and 34;

It is to be understood that the drawings are for the purpose of description and illustration only and are not intended, and should not be construed, as a definition of the limits of the invention.

V. DETAILED DESCRIPTION OF THE PREFERRED EMBODIMENTS

Figure 1:
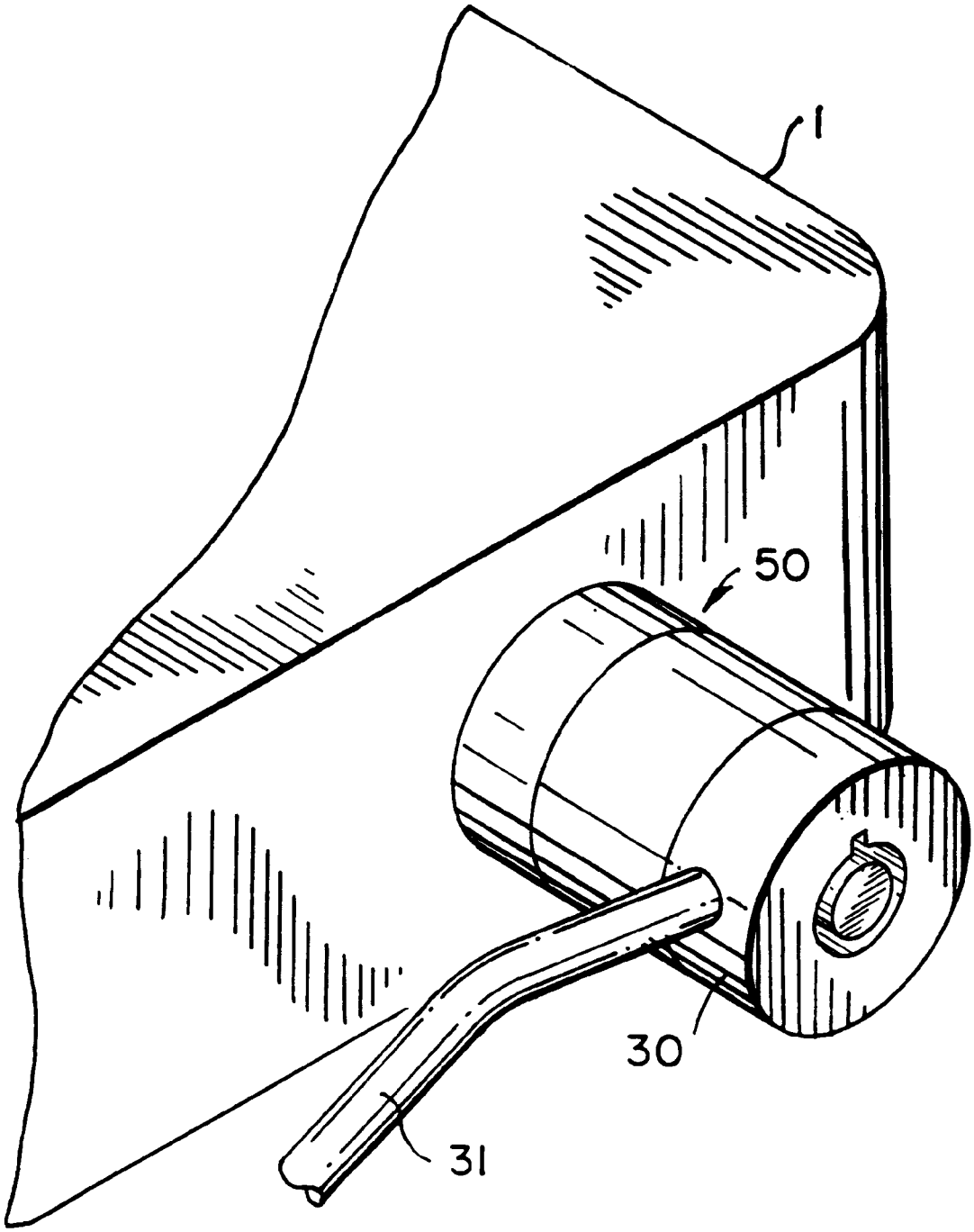
FIG. 1 is an isometric view of a first preferred embodiment of the present invention attached to the security slot of the portable valuable.

FIG. 1 depicts a first preferred embodiment of the locking mechanism 50 installed in the security slot of a personal, portable valuable 1. Attached to the locking mechanism 50 is a cable lock 30. The cable 31 of the cable lock 30 is looped around or through some large, relatively immovable object (not shown), and cable lock 30 is passed through a closed loop (not shown) at the end of cable 31. The cable lock 30 then engages and locks to the cylindrical housing of the locking mechanism thereby preventing theft of the portable device.

Figure 2:
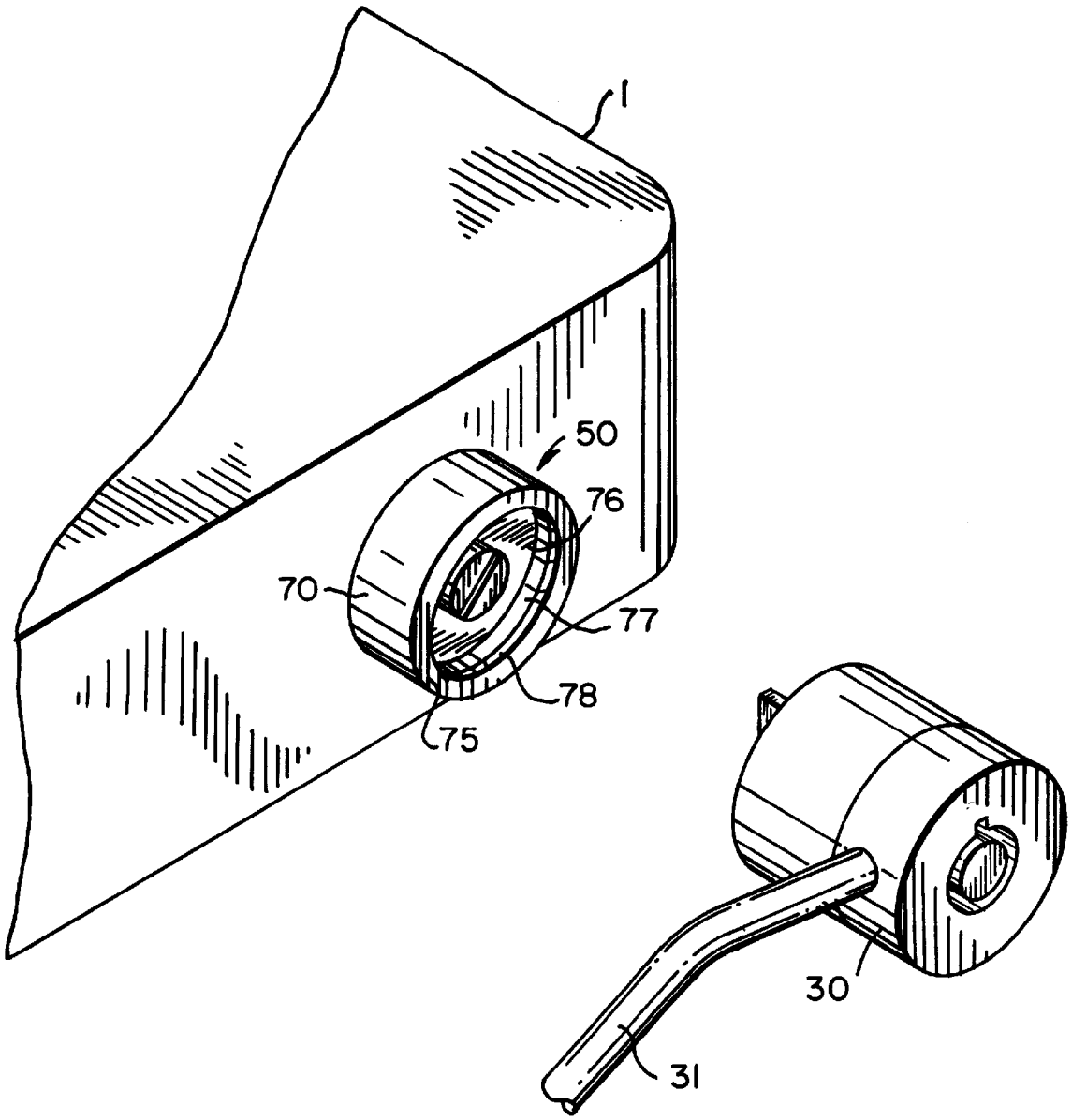
FIG. 2 is an isometric view of a first preferred embodiment of the invention showing the locking mechanism installed in a locked position in the security slot of the portable valuable, with the cable lock detached.

FIG. 2 depicts the cable lock 30 detached from the locking mechanism 50 of the present invention. The bottom, outward-facing surface 75 of the housing 70 of the locking mechanism 50 has a recessed surface 76. Extending outward from this recessed surface 76 is a circumferential flange 77. Circumferential flange 77 has an edge 78 that extends inward away from the circumferential flange 77 in a plane parallel to the recessed surface 76. Together, the surface 75, the circumferential flange 77, and edge 78 form a lock receptacle for receiving and engaging a cable lock 30. That is, when installed, the cable lock 30, fits under and engages the circumferential flange 77 and edge 78.

Figure 3:
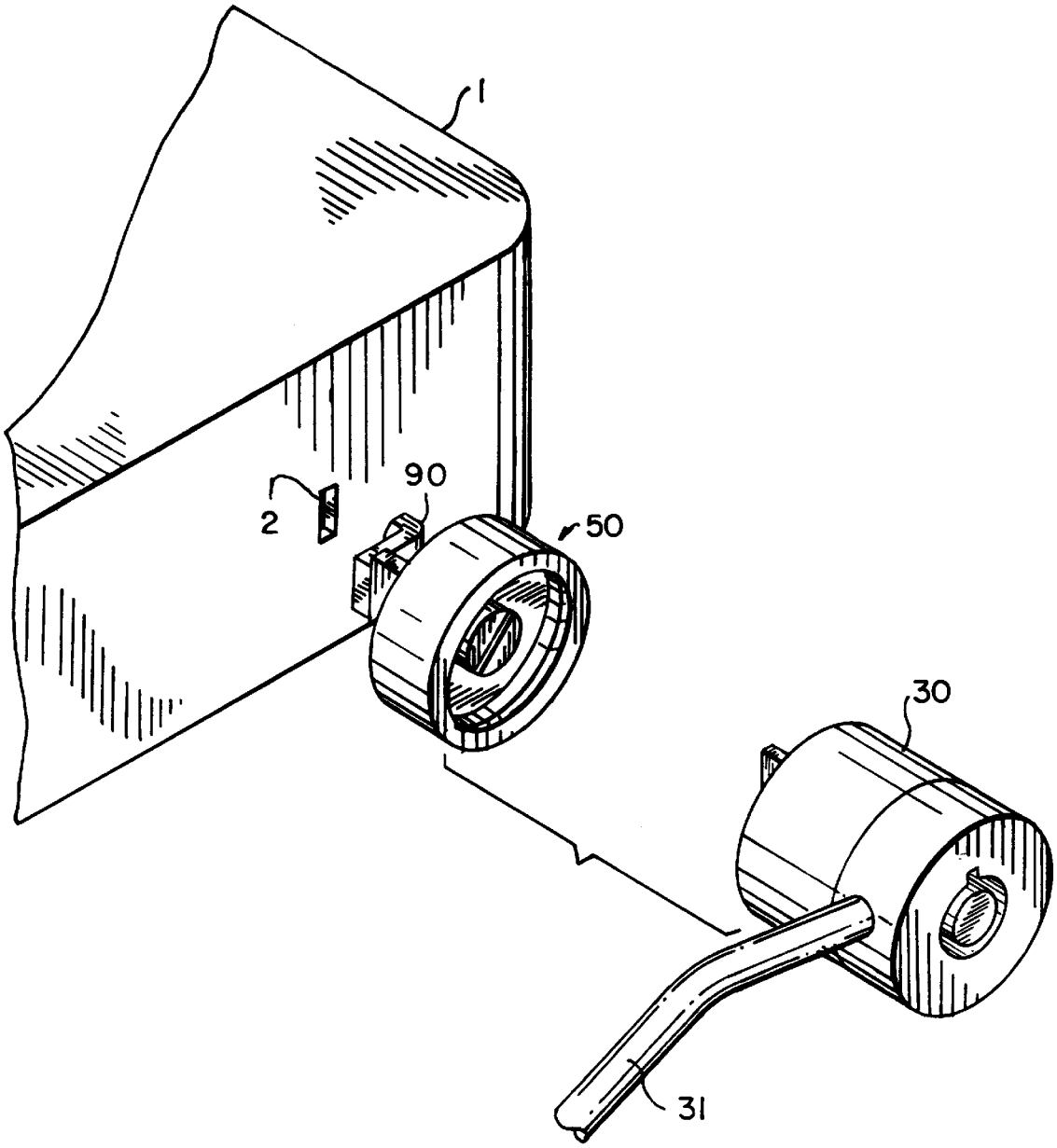
FIG. 3 is an isometric view of a first preferred embodiment of the present invention showing security slot of the portable valuable, the locking mechanism of the invention, and a cable lock.

FIG. 3 depicts the locking mechanism 50 detached from the security slot 2 of the portable valuable 1. Clearly evident is the restraining member 90 of the locking mechanism 50.

The general theory of operation of locking mechanisms embodying the present invention, as well as a detailed description of the first preferred embodiment 50 of the present invention is shown in FIGS. 4–17.

Figure 4:
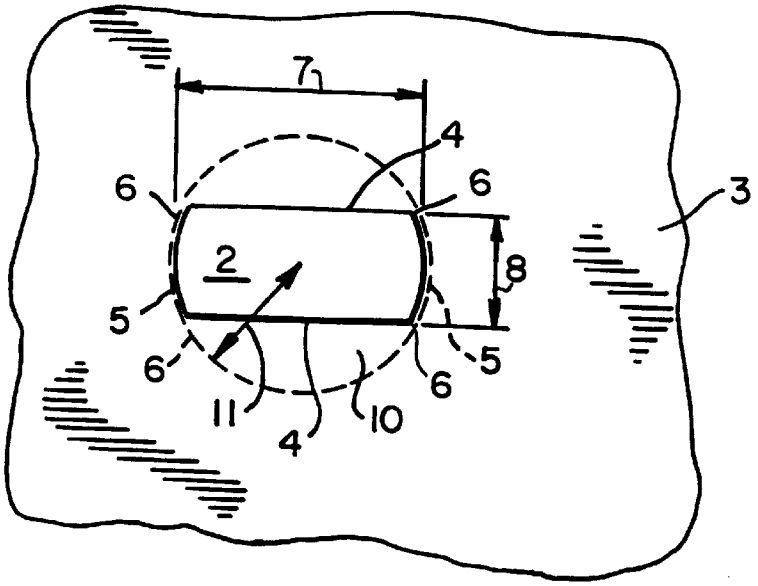
FIG. 4 is a fragmentary elevation view of a security slot in a portable valuable by which the locking mechanism of embodiments of the present invention may be secured to the portable valuable.

FIG. 4 illustrates the security slot 2 formed, by molding or otherwise as appropriate, in an exterior wall 3 of a portable valuable. The present "industry standard" security, or restraining slot has a generally rectangular configuration with long parallel sides 4 and short parallel sides 5, and rounded corners 6. The long dimension 7 of the slot is about seven millimeters and the short dimension 8 is about three millimeters. The corners 6 typically have a radius of curvature from about 0.3 millimeters to 1.5 millimeters. Surrounding the slot 2 is a circular space 10 concentric with the center of the slot and having a radius 11 approximately equal to half the long dimension 7 of the slot 2. Manufacturers of portable valuables incorporated with a security slot have reserved this circular space 10 for use by locking mechanisms (i.e. electrical wiring, circuits, structures or other components or pieces of the portable device are not placed within this reserved space.)

FIG. 5 shows a restraining member 90 of the first preferred embodiment. The restraining member 90 comprises an upper flange 91, a shank 92, and a hook member 93 with a corner junction 96 and a distal end 95. In operation, distal end 95 is inserted into a security slot 2 as more fully described hereinafter.

Figure 6:
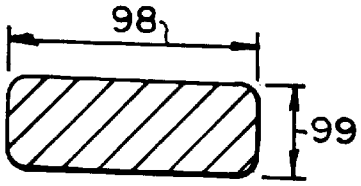
FIG. 6 is a cross-sectional view taken along line a—a of FIG. 5.
Figure 7:
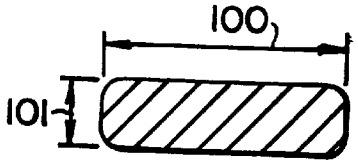
FIG. 7 is a cross-sectional view taken along line b—b of FIG. 5.

The peripheral dimensions of the shank 92 and hook member 93, except in the vicinity of corner junction 96, are closely conformed to the interior dimensions of slot 2 as shown in cross-section in FIGS. 6 and 7, respectively. The shank 92 and hook portion 93 of restraining member 90 have a straight-sided rectangular configuration, though the ends may be beveled or rounded to more closely conform to the interior dimensions of the security slot 2. The long dimension 98 of the shank 92 and the long dimension 100 of hook member 93 are slightly less than the long dimension 7 of the slot 2, preferably about 6.6 millimeters, and the short dimensions 99 and 101 are slightly less than the short dimension 6 of the slot 2, preferably about 2.4 and about 1.9 millimeters, respectively; except in the vicinity of corner junction 96.

As more readily discernable from FIGS. 8*a–c*, corner junction 96 is approximately 90 degrees, and is opposed by a curvature 94. Dimension 102 at or near the bisection of the angle of corner junction 96 is less than short dimension 99 of shank 92 and short dimension 101 of hook member 93. In a preferred embodiment, dimension 102 is about 1.3 millimeters. Curvature 94 provides a radial or beveled transition along shank 92 and hook member 93 from short dimension 99 to dimension 102 and from dimension 102 to short dimension 101. Corner junction 96 and curvature 94 may be formed by forging, casting or other appropriate method, and enable the restraining member 90 to fit into and be installed securely in the restraining slot 2.

Further, distal end 95 of hook member 93 has a curvature 97 with a radius 104 corresponding to radius 11 of the circular space 10 surrounding security slot 2 to thereby maximize the surface contact between hook member 93 and wall 12 of the portable valuable when the hook member 93 is inserted and secured in the security slot 2, as illustrated in FIG. 9.

Figure 10D:
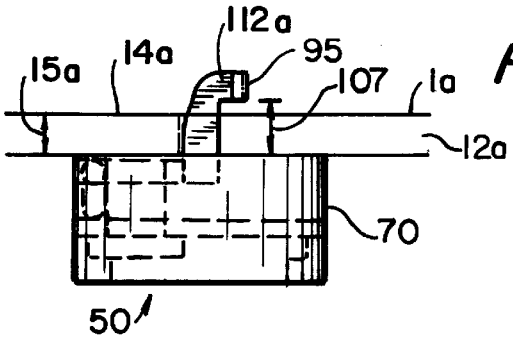
Figure 10E:
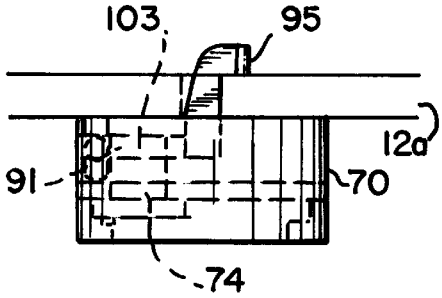
Figure 10B:
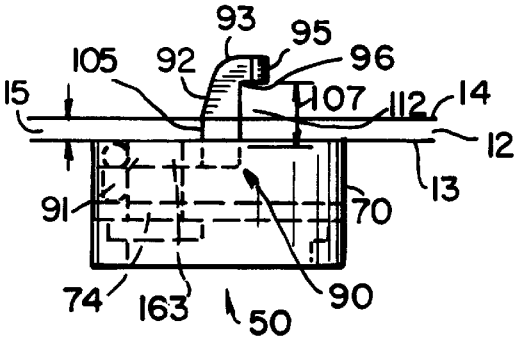
Figure 10C:
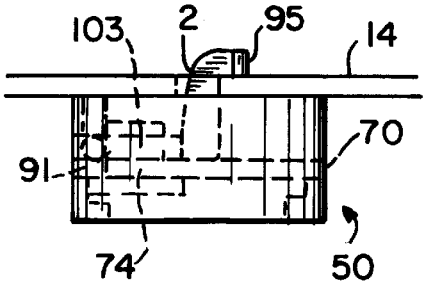
Figure 10A:
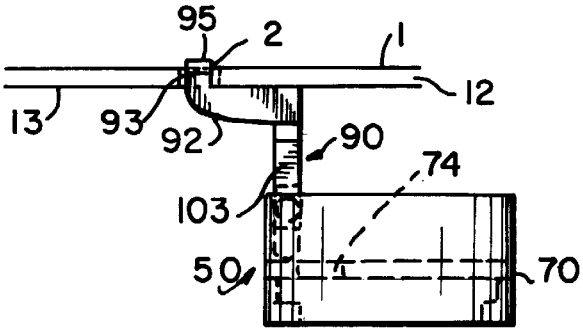

FIGS. 10*a–c* show the installation of the restraining member 90 into the restraining slot 2 of a portable device 1. The steps of installation are depicted starting in FIG. 10*a*. The distal end 95 of the hook member 93 is aligned with the security slot 2; the shank 92 of the restraining member 90 is generally parallel to the exterior mounting surface 13 of the wall 12 of portable valuable 1. In the next step, shown in FIG. 10*b*, the housing 70 is laterally translated causing the restraining member 90 to translate and pivot affecting insertion of the distal end 95 of the hook member 93 into the security slot 2. In FIG. 10*b* the upper flange 91 lies flush against the mounting surface 13. As can be seen, the thickness 15 of wall 12 is relatively less than the dimension 107 between corner junction 96 and corner junction 105 at the junction of flange 91 and shank 92 (which dimension 107 is preferably about 4 to 4.5 millimeters), and there is a resultant gap 112 between the distal end 95 of the restraining member 90 and the inner surface 14 of the wall 12. The upper flange has a threaded screw hole 103 (shown in dashed lines) that aligns with a similar through hole 74 (shown in dashed lines) in the housing 37 of the locking mechanism 50. When a screw (not shown) is threaded into screw holes 103 and 74 and is tightened, flange 91 is drawn inward of the housing 70 and distal end 95 is drawn into secure contact with the inner surface 14 of the security slot 2, as shown in FIG. 10*c*.

FIGS. 10*d–e* show similar installation steps for a portable valuable 1 having an exterior wall 12*a* having a thickness 15*a* only slightly less than the dimension 107 of the restraining member 90. As can be seen in FIG. 10*d*, there is a smaller gap 112*a* between the distal end 95 of the hook member and the inner surface 14*a* of the wall 12*a* of the portable valuable. This small gap, however, is closed by locking mechanism 50, as shown in FIG. 10*e*, in the same manner as described in reference to FIGS. 10*b–c*.

To remove the locking mechanism from the portable device the fastener is removed from the aperture (screw hole) in the inner flange of the restraining member and the above described steps are followed in reverse.

Once the restraining member 90 is inserted into the security slot 2 and the screw has been tightened to secure surface contact between the distal end 95 and the inner surface 14 of the wall of the portable valuable, the locking mechanism cannot be removed from the portable valuable without breaking either the locking mechanism or the exterior wall of the portable valuable to which it is attached.

Alternatively, a restraining member 90*a* illustrated in FIGS. 11 and 12*a–c* may be employed in the locking mechanism of the present invention. Similar to restraining member 90, restraining member 90*a* comprises an upper flange 91 a, a shank 92*a*, and a hook member 93*a* with a corner junction 96*a* and a distal end 95*a*.

As with restraining member 90, the peripheral dimensions of the shank 92*a* and hook member 93*a*, except in the vicinity of corner junction 96*a*, are closely conformed to the interior dimensions of restraining slot 2. The shank 92*a* and hook portion 93*a* of restraining member 90*a* have a straight-sided rectangular configuration, though the ends may be beveled or rounded to more closely conform to the interior dimensions of the security slot 2. The long dimension of the shank 92*a* and the long dimension of hook member 93*a* are slightly less than the long dimension of the slot 2, preferably about 6.6 millimeters, and the short dimensions of the shank 92*a* and of the hook member 93*a* are slightly less than the short dimension of the slot 2, preferably about 2.4 and about 1.9 millimeters, respectively; except in the vicinity of corner junction 96*a*.

As shown by FIGS. 12*a–c*, corner junction 96*a* is approximately 90 degrees, and is opposed by a curvature 94*a*. Dimension 102*a* at the bisection of the angle of corner junction 96*a* is less than short dimension 99*a* of shank 92*a* and short dimension 101*a* of hook member 93*a*. Preferably, dimension 102*a* is about 1.3 millimeters. Curvature 94*a* provides a radial or beveled transition along shank 92*a* and hook member 93*a* from short dimension 99*a* to dimension 102*a* and from dimension 102*a* to short dimension 101*a*. Corner junction 96*a* and curvature 94*a* may be formed by forging, casting or other appropriate method, and enable the restraining member 90*a* to fit into and be installed securely in the security slot 2.

Further, as with restraining member 90, distal end 95*a* of hook member 93*a* of restraining member 90*a* has a curvature 97*a* with a radius corresponding to the radius of the circular space surrounding security slot 2 to thereby maximize the surface contact between hook member 93*a* and inner surface 14 of wall 12 of the portable valuable when the hook member 93*a* is inserted and secured in the security slot 2.

Figure 13A:
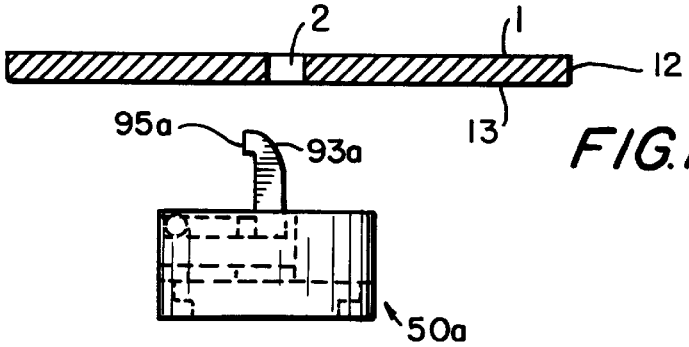
Figure 13B:
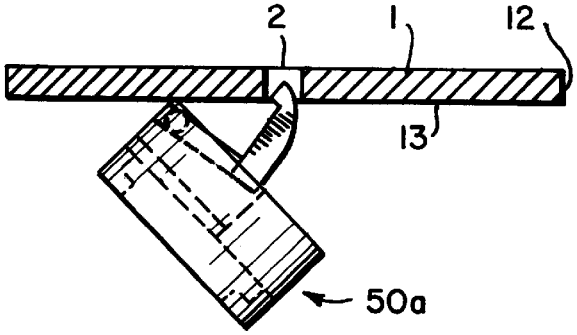
Figure 13C:
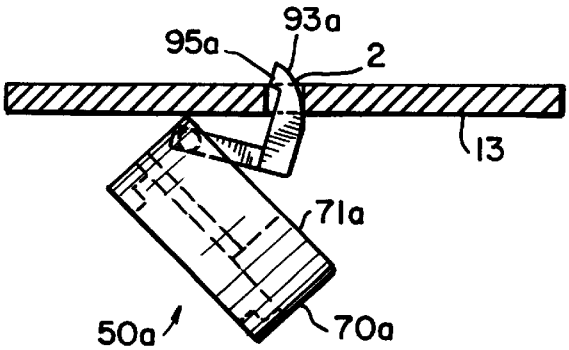
Figure 13D:
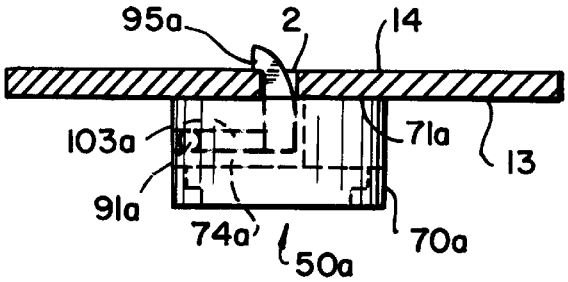

FIGS. 13*a–d* show the installation of the restraining member 90*a* into the security slot 2 of a portable valuable 1. The steps of installation are depicted starting in FIG. 13*a* showing a locking mechanism 50*a* ready for attachment to a portable valuable 1. The distal end 95*a* of the hook member 93*a* is inserted at a angle of about 45 degrees to the exterior mounting surface 13 of the wall 12 of portable valuable 1 as shown in FIG. 13*b*. Next, as shown in FIG. 13*c* the restraining member is rotatably translated and pivoted to affect insertion of the distal end 95*a* of the hook member 93*a* into the security slot 2. The housing 70*a* is then rotatably translated until its outer surface 71*a* is parallel to, and lies flush against the mounting surface 13. As in restraining member 90, the upper flange 91*a* has a screw hole 103*a* (shown in dashed lines) that aligns with a similar through hole 74*a* (shown in dashed lines) in the housing 70*a* of the locking mechanism 50*a*. When a screw (not shown) is passed through hole 74*a* and threaded into screw hole 103*a* and is tightened, flange 91*a* is drawn inward of the housing 70*a* and distal end 95*a* is drawn into secure contact with the inner surface 14 of the security slot 2, without any appreciable gap, as shown in FIG. 13*d*.

Once the restraining member 90*a* is inserted into the security slot 2 and the screw has been tightened to secure surface contact between the distal end 95*a* and the inner surface 14 of the wall of the portable valuable, the locking mechanism cannot be removed from the portable valuable without breaking either the locking mechanism or the exterior wall of the portable valuable to which it is attached.

The first preferred embodiment of the locking mechanism for portable valuables 50 is further illustrated by FIGS. 14–17. The locking mechanism 50 has a generally cylindrical housing 70 with a cylindrical outer wall 80, an outer surface 71 intended to be in facing contact with the portable valuable when in the locked position, and an opposing outer surface 75 intend to be outward facing from the portable valuable. Fabricated in surface 71 is a recessed mounting cavity 72. Mounted within the recessed cavity 72 is the restraining member 90 which is shown to better advantage in FIG. 5. The restraining member 90 comprises an upper flange 91, a shank 92 and a hook member 93. The upper flange 91 is shaped to conform to the outer contour of the recessed cavity 72 of the housing 70. The outward facing curvature 94 of the shank 92 and hook member 93 has an arcuate cross section as more fully described here above with reference to FIGS. 8*a–c*. This provides clearance for the shank and hook member during installation into the security slot. Extending outward from two opposite sides of the upper flange 91 are pins 106. The pins 106 are intended to be mounted in circular slots 73 machined or molded in opposite walls 82 of the recessed cavity 72. The slots permit rotational and translational movement of the restraining member 90 when the pins 106 of the restraining member 90 are mounted in the slots 73.

In alternative preferred embodiments, the elliptical slots 73 of this first preferred locking mechanism 50 may be replaced by vertical slots extending through the top surface of the locking mechanism housing (as shown in FIGS. 18 and 19), by horizontal linear slots (as shown in FIGS. 22 and 23), a circumferential slot (as shown in FIGS. 26 and 27), or eliminated (as shown in FIGS. 29 and 30) as described hereinafter.

A threaded screw hole 103 is also fabricated in the upper flange 91 of the restraining member 90. When the restraining member is in the locking position shown in FIG. 15, the threaded screw hole 103 in the upper flange 91 aligns with a matching (threaded or non-threaded) screw hole 74 in the bottom of the recessed cavity 72. Once the restraining member 90 has been installed in the security slot of 15 the portable valuable as described above and depicted in FIGS. 10*a–e*, the housing 70 is rotated down onto the upper flange 91 of the restraining member 90. This aligns the screw hole 74 in the recessed cavity 72 with the screw hole 103 in the upper flange 91. Tightening of a captive screw 108 engages the threaded screw hole 103 of the upper flange 91, locking the housing 70 and restraining member 90 in locked alignment with the security slot of the portable valuable.

FIGS. 16 and 17*a* illustrate locking mechanism 50 in locked alignment with the security slot (not shown) of a portable valuable (not shown). The bottom, outward-facing surface 75 of the housing 70 has a recessed surface 72 or 76 in a plane substantially parallel to surface 75. Extending substantially perpendicular to and outward from recessed surface 76 to surface 75 is a circumferential flange 77. A circumferential edge 78 extends from circumferential flange 77 inward toward the central axis 83 of the housing 70 in a plane substantially parallel to recessed surface 76. The combination of the outward facing surface 75, the circumferential flange 77, and the edge 78 forms a lock receptacle 85 for receiving and engaging a cable lock (not shown).

The lock receptacle 85 is further illustrated in cross-section in FIG. 17*d*. Circumferential edge 78 has an inner surface 86 substantially parallel to surface 75 and a dimension 84 sized to permit the insertion of an appropriate cable lock into the lock receptacle 85 and to securely engage the engagement means of the selected lock at inner surface 86. In FIG. 17*d* dimension 84 of edge 78 is sized such that lock receptacle 85 will receive and securely engage a clip-type cable lock such as those known in the art and commercially readily available. Preferably dimension 84 is about 1 to 1.5 millimeters.

In FIG. 17*b*, an alternative embodiment, 50*b*, of the lock receptacle according to the present invention is depicted wherein dimension 84*b* (not shown) of edge 78*b* is sized such that the lock receptacle 85*b* will receive and securely engage a ball-type lock such as that described in U.S. Pat. No. 4,742,703 and others known in the art and commercially available. Preferably dimension 84*b* is about 1.5 millimeters.

FIG. 17*c* illustrates another alternative embodiment, 50*c*, of a lock receptacle of the present invention, 85*c*, intended to receive and securely engage a one-way latch clip-type lock such as that described in U. S. Pat. No. 4,819,464 and others known in the art and commercially available. As shown in FIG. 17*c*, a radial flange 87, centered about the central axis 89 of a locking mechanism housing 70*c*, extends substantially perpendicular to and outward from a recessed surface 76*c* and towards an outward-facing surface 75*c*. A planar edge 88 extends from radial flange 87 outward away from the central axis 79 of the housing 70*c* in a plane substantially parallel to recessed surface 76*c*. The combination of the outward facing surface 75*c*, the radial flange 87, and the edge 88 forms the lock receptacle 85*c* for receiving and engaging a latch-type cable lock (not shown).

In FIGS. 18–21 a second preferred embodiment of the locking mechanism, 50*d*, is constructed similar to the first preferred embodiment of the locking mechanism 50 illustrated and described above. However, locking mechanism 50*d* has vertical slots 73*d* machined or molded in opposite walls 82*d* of the recessed mounting cavity 72*d* and extending openly through the top outer surface 71*d* of the housing 70*d*. The slots 73*d* allow a restraining member 90 to be inserted and mounted in the recessed cavity 72*d* and permit rotational and translational movement of the restraining member 90 when its pins 106 are mounted in slots 73*d*.

In the locking position, shown in FIG. 18, a threaded aperture 103*d* in the upper flange 91*d* of restraining member aligns with an aperture 74*d* in the bottom of the recessed cavity 72*d*. A screw (not shown) can the be placed in aperture 74*d* and threaded into threaded aperture 103*d* to lock the housing 70*d* and restraining member 90*d* in locked alignment with the security slot of a portable device. As illustrated in FIG. 20, a lock receptacle 85*d* for receiving and engaging a cable lock (not shown) is formed by the combination of an outward facing surface 75*d*, a circumferential flange 77*d*, and an edge 78*d*, the same as above described with reference to locking mechanism 50.

To capture restraining member 90*d* within recessed cavity 72*d*, a cover 120 is provided. Cover 120 comprises a top surface 121, and a bottom adhesive surface 122 as shown in FIG. 21. The cover 120 is sized to cover and adhesively adhere to the top outer surface 71*d* of the housing 70*d* of the locking mechanism 50*d* to thereby permit attachment and securing of cover 120 to the housing 70*d*. An opening 123 in the top surface 121 extending through the bottom surface 122 is sized and configured to allow rotational and translational movement of restraining member 90 when pins 106 are mounted in slots 73*d* yet prevent restraining member 90 from becoming dismounted from recessed cavity 72*d*.

In FIGS. 22–24, a third preferred embodiment of the locking mechanism, 50*e*, is constructed similarly to the first embodiment of the locking mechanism 50 depicted and described above, with the exception that the recessed mounting cavity 72*e* of the housing 70*e* has an open side 79 that extends through the outer cylindrical wall 80*e* of the housing 70*e*. Also, fabricated on opposite walls 82*e* of the recessed cavity 72*e* are linear slots 81. The pins 106 of the restraining member 90 are mounted in slots 81. When mounted in slots 81, the restraining member 90 can be moved to an installation position where the shank 92 of the restraining member 90 extends outward and beyond the cylindrical wall 80*e* of the housing 70*e*, as depicted in FIG. 22.

FIGS. 25*a–c* illustrate the installation of the restraining member 90*e* of locking mechanism 50*e* into the security slot 2 of a portable valuable 1. As shown in FIG. 25*a*, the distal end 95*e* of the hook member 93*e* is aligned with the security slot 2; the shank 92*e* of the restraining member 90*e* is generally parallel to the exterior mounting surface 13 of the wall 12 of the portable device 1; and the bottom surface 75*e* and the top surface 71*e* of housing 70*e* are generally perpendicular to mounting surface 13. Next, as shown in FIG. 25*b*, the housing is rotated substantially 90 degrees to bring top surface 71*e* generally parallel to, and flush against, surface 13.

After the restraining member 90*e* has been mounted in the security slot of the portable device, the housing 70*e* is rotatably translated to align the threaded screw hole 103*e* in the upper flange 91*e* of the restraining member 90*e* with the non-threaded screw hole 74*e* of the housing 70*e* as shown in FIG. 25*c*. The captive screw 108*e* is then tightened, thereby engaging the screw hole 103*e* of the upper flange 91*e*. As with the first preferred embodiment 50, this operation locks the restraining member and housing in fixed alignment, preventing removal of the locking mechanism 50*e* from the security slot of the portable valuable.

A lock receptacle 85*e* for receiving and engaging a cable lock (not shown) is formed in locking mechanism 50*e*, as illustrated in FIG. 24, by the combination of an outward facing surface 75*e*, a circumferential flange 77*e*, and an edge 78*e*, to couple locking mechanism 50*e* to an object (not shown) other than the portable valuable.

Turning now to FIGS. 26–28, a fourth preferred embodiment, 50*f*, of the locking mechanism for portable valuables is constructed similarly to the first preferred embodiment 50 of the locking mechanism discussed above, with the exception that the recessed cavity 72*f* of the housing 70*f* has a circular cross section, and an open side 79*f* that extends through the outer cylindrical wall 80*f* of the housing 70*f*. Further, fabricated in the circular side walls 82*f* of the mounting cavity 72*f* is a circumferential slot 89. The pins 106 of the restraining member 90 are mounted in the circumferential slot 89. The upper flange 91 of the restraining member 90 is shaped to permit circular rotation of the restraining member 90 when the pins 106 are mounted in the circumferential slot 89 of the recessed cavity 72*f*. The restraining member is moveable between at least an installation position and a locking position. In the installation position depicted in FIG. 26, the restraining member 90 is rotated so that the shank 92 aligns with the outer cylindrical wall 80*f* of the housing 70*f* After the restraining member 90 has been installed in the security slot of the portable valuable in the same manner as above described with reference to the third preferred embodiment 50*e* and as depicted in FIGS. 25*a–b*, the housing 70*f* is rotated to align the screw hole aperture 103 in the upper flange 91 of the restraining member with the screw hole aperture 74*f* in the bottom of the mounting cavity 72*f*, as depicted in FIG. 27. As with other preferred embodiments, a captive screw fastener 108 is then tightened, thus engaging the screw hole aperture 103 of the upper flange 91, and thereby locking the restraining member and housing in fixed alignment, and preventing removal of the locking mechanism 50*f* from the restraining slot of the portable valuable.

As illustrated in FIG. 28, the combination of an outward facing surface 75*f*, a circumferential flange 77*f*, and an edge 78*f* define a lock receptacle 85*f* for receiving and engaging a cable lock (not shown) to thereby couple the locking mechanism 50*f* to an object (not shown) other than the portable valuable (not shown).

A fifth preferred embodiment, 50*g*, of the locking mechanism for portable valuables is constructed similarly to the fourth preferred embodiment 50*f* of the locking mechanism discussed above, with a recessed mounting cavity 72*g* having a circular cross section and an open side 79*g* that extends through the outer cylindrical wall 80*g* of the housing 70*g* is illustrated by FIGS. 29–32. However, in the circular side walls 82*g* of the recessed mounting cavity 72*g* there is no circumferential slot, and the restraining member 90*g* has no mounting pins. To capture restraining member 90*g* within recessed cavity 72*g*, a cover 130 is provided. Cover 130 comprises a top surface 131, and a bottom adhesive surface 132 as shown in FIG. 32. The cover 130 is sized to cover and adhesively adhere to the top outer surface 71*g* of the housing 70*g* of the locking mechanism 50*g* to thereby permit attachment and securing of cover 130 to the housing 70*g*. An opening 133 extending through the top surface 131 and the bottom surface 132 is sized and configured to allow circular rotation of restraining member 90*g* when mounted in recessed mounting cavity 72*g* yet prevent restraining member 90*g* from becoming dismounted from recessed mounting cavity 72*g*. The upper flange 91*g* of the restraining member 90*g* is shaped to permit circular rotation of the restraining member 90*g* when the upper flange is mounted in the recessed cavity 72*g*. The restraining member is moveable between at least an installation position and a locking position. In the installation position, the restraining member 90*g* is rotated so that the shank 92*g* aligns with the outer cylindrical wall 80*g* of the housing 70*g*. After the restraining member 90*g* has been installed in the security slot of the portable valuable in the same manner as above described with reference to the fourth preferred embodiment 50*f* and as depicted in FIGS. 25*a–b*, a captive screw (not shown) is tightened, engaging the screw hole 103*g* of the upper flange 91*g*, and thereby locking the restraining member and housing in fixed alignment, and preventing removal of the locking mechanism 50*g* from the security slot of the portable valuable.

FIGS. 33–36 illustrate a sixth preferred embodiment, 140, of the locking mechanism for portable valuables which comprises a restraining member 150, a housing 160 and a bearing structure 170. The theory of operation of the sixth preferred embodiment is depicted in FIGS. 33*a–c*. The restraining member comprises a threaded worm gear portion 151, a shank 152, and a hook member 153. The outward facing portion of the shank 152 and hook member 153 has an arcuate cross section to permit clearance during installation of the restraining member into the security slot of the portable valuable. The restraining member 150 of the sixth preferred embodiment is installed in a similar manner as the restraining member depicted in FIGS. 10*a–e*. Once installed, the restraining member is brought into a locking position as depicted in FIGS. 33*a–c*. FIG. 33*a* depicts the initial installation position. The restraining member 150 has two outwardly facing pins 154 that have partial circular and rectangular cross sections. These pins are intended for mounting in a bearing structure having oppositely facing bearing surfaces that have circular and rectangular cross sections (shown in phantom as 175). As the worm gear is rotated, the restraining member, 150, initially rotates in that portion of the bearing surface that has a circular cross section. In this initial stage, the portion of the pins 154 having circular cross sections are in contact with those portions of the bearing surface having a circular cross section. As the rotation of the worm gear continues, the housing of the locking mechanism rotates down onto the outer surface of the portable valuable. Next, those portions of the pins having rectangular cross sections align with the portions of the bearing surfaces having rectangular cross sections, as illustrated in FIG. 33*b*. As the worm gear continues to be tightened, as illustrated in FIG. 33*c* the housing is linearly displaced, and is brought into facing engagement with the mounting surface of the portable valuable.

The construction of the sixth preferred embodiment, 140, of the locking mechanism is further depicted in FIGS. 34–36. The bearing structure 170 comprises a bottom facing wall 171 intended to be in facing engagement with the mounting surface of the portable valuable when the locking mechanism is installed in the security slot. Extending upward from the wall 171 are oppositely facing walls 172. Machined in these walls are the bearing surfaces 175. As can be seen, the bearing surfaces 175 have circular and rectangular cross sections. Connecting the two bearing walls 172 is a joining member 174. Machined or molded in the joining member 174 is screw hole 173 for the worm screw 179.

Each of the preferred embodiments of the locking mechanism, 50*d*, 50*e*, 50*f* 50*g* and 140 have, as shown in FIGS. 20, 24, 28, 31 and 36, respectively, a lock receptacle (85*d*, 85*e*, 85*f*, 85*g*, and 185) formed of the same elements as above described with respect to FIG. 17*a* and preferred embodiment 50. And, as with preferred embodiment 20, preferred embodiments 50*d*, 50*e*, 50*f*, 50*g* and 140 may have alternative lock receptacles, such as those shown in FIGS. 17*b* and 17*c*, in order to receive and engage different cable locks as above described with respect to preferred embodiment 50.

Additionally, the locking mechanism of the present invention may be integrated with a cable lock in a single unit.

Another preferred embodiment, 200, of the locking mechanism for portable valuables is illustrated by FIGS. 37–40. The locking mechanism 200 has a generally cylindrical housing 201 with a cylindrical wall 202, an outer surface 203 intended to be in facing contact with the portable valuable when in the locked position, and an opposing outer surface 204 intend to be outward facing from the portable valuable. Outer surface 204 has a recessed surface 212 in a plane substantially parallel to it, which together with cylindrical wall 202 and surface 204 define a cylindrical security cavity 213. A pair of apertures 210 are provided through cylindrical wall 202 and are sized to permit a cable 220 of a cable lock (not shown) to pass through the apertures 210.

Fabricated in surface 203 is a recessed cavity 205. Mounted within the recessed cavity 205 is a restraining member 206, which has been previously described with reference to preferred embodiment 50. A threaded screw hole 208 is also fabricated in the upper flange 207 of the restraining member 206. When the restraining member is in the locking position shown in FIGS. 37 and 40, the threaded screw hole 208 in the upper flange 207 aligns with a matching screw hole 209 in the bottom of the recessed cavity 205. Once the restraining member 205 has been installed in the security slot of the portable valuable as described above and depicted in FIGS. 10*a–e*, the housing 201 is rotated down onto the upper flange 207 of the restraining member 206. This aligns the screw hole 209 in the recessed cavity 205 with the screw hole 208 in the upper flange 207. Tightening of a captive screw fastener 211 engages both the screw hole 209 in the recessed cavity 205 and the threaded screw hole 208 of the upper flange 207, locking the housing 201 and restraining member 206 in locked alignment with the security slot of the portable device.

Once the locking mechanism 200 is in locked alignment with the restraining slot (not shown) of a portable valuable (not shown), as illustrated by FIG. 39, a cable 220 can be threaded through apertures 210 in the locking mechanism 200 and be attached to an external cable lock (not shown). The cable 220 passing through locking mechanism 200 prevents access to, and removal of, captive screw 211 from both the screw hole 209 in the recessed cavity 205 and the threaded screw hole 208 of the upper flange 207, thus precluding theft of the portable valuable by removal of the locking mechanism 200.

Preferably, the free end of cable 220 has an end-stop head 221 of the type adapted to penetrate and to be secured within a key lock (not shown) or a combination lock (not shown). With the cable 220 threaded through the apertures 210 of locking mechanism 200, it may then be wrapped around a relatively immovable object (not shown) and the end-stop head 221 is inserted into the cable lock (not shown) and the lock is closed and locked thereby securing the portable valuable to the immovable object.

The embodiment of FIGS. 37–40 can be modified to provide it with a security spindle 250 to form locking mechanism 260, as shown in FIGS. 41–44. Security spindle 250 is sized and configured to be rotatably mounted within the cylindrical cavity 213 of locking mechanism 200. Security spindle 250 includes a cylindrical portion 251 having cylindrical sidewall 252 and a raised circular plate 253 at one end which forms its aft end. A pair of apertures 254 are provided in side wall 252. Apertures 254 are spaced and sized to align with apertures 210 of locking mechanism 200 when mounted within the cylindrical cavity 213, and to allow a securing device such as the cable 220 to pass through the apertures. A rectangular slot 255 in raised plate 253 extends through the length of the security spindle 250. The rectangular slot 255 is sized and configured to permit the blade of a screwdriver (not shown) or the edge of a coin (not shown) to be inserted through the security spindle to engage the captive screw 211 of locking mechanism 200. FIG. 41 shows security spindle 150 assembled to locking mechanism 100 to form locking mechanism 260.

In operation, locking mechanism 260 is attached to a personal device in the same manner as above described with respect to locking mechanism 200, and a screw driver or coin is inserted into and through the rectangular slot 255 to engage and tighten captive screw 212. Once locking mechanism 260 is secured to the personal valuable, security spindle 250 is rotated to align apertures 254 with apertures 210 and cable 220 of a cable lock is threaded through the aligned apertures 210 and 254.The personal valuable then may be secured to a relatively immovable object in the manner above described. The security spindle 250 now can neither be removed or rotated due to the cable threaded through the apertures 210 and 254 and the locking mechanism cannot be removed from the personal valuable.

Alternatively, the security spindle 250 may be inserted into cavity 213 of locking mechanism 200, after locking mechanism 200 has been attached to the personal valuable.

Another preferred embodiment of the locking mechanism of the present invention is illustrated by FIGS. 45–48. Locking mechanism 300 has a generally cylindrical housing 330 with an outer surface 371 intended to be in facing contact with the personal, portable device when in the locked position and an opposing outer surface 375 intended to be outward facing from the portable device. Extending outward from outer surface 375 is a generally rectangular flange 376 with straight sides 377 and semicircular ends. Traversing through the sides 377 of the flange 376 is an aperture 378 which is sized to allow a cable 35 or a shackle 41 of a lock 40 to extend there through and thereby couple the housing 330 with another object.

Fabricated in surface 371 is a recessed surface 372 having substantially parallel walls 382, which together define a mounting cavity for mounting a restraining member 390. The restraining member is of the type depicted in FIG. 5, and comprises an upper flange 391, a shank 392 and a hook member 393. A screw hole 403 is provided in upper flange 391.

When the restraining member is in the locking position shown in FIG. 45, the threaded screw hole 403 in the upper flange 391 aligns with a matching screw hole 374 in the recessed surface 372. Once the restraining member 390 has been installed in the security slot of the portable valuable as described above and depicted in FIGS. 10*a–e*, the housing 330 is rotated down onto the upper flange 391 of the restraining member 390. This aligns the screw hole 374 in the recessed surface 372 with the screw hole 403 in the upper flange 391. An axial aperture 379 through the end of the flange 376 to screwhole 374 in the recessed surface 372 permits tightening of a captive screw 408 which engages both the screw hole 374 in the recessed cavity 372 and the threaded screw hole 403 of the upper flange 391, locking the housing 330 and restraining member 390 in locked alignment with the security slot of the portable valuable.

The preferred embodiments of locking mechanisms of the present invention heretofore described are designed to operate with personal, portable valuables provided with a security slot, such as security slot 2 depicted in FIGS. 3 and 4. Embodiments of the present invention, designed primarily to secure a personal valuable not having a security slot fabricated therein, is illustrated generally by way of reference to FIGS. 49–53.

FIG. 49 illustrates locking mechanism 400 affixed to the surface 451 of a personal valuable 450. Locking mechanism 400 comprises a flat plate 411 with an upper surface 412 and a bottom surface 413. The upper surface 412 has a raised surface 414 in a plane substantially parallel to the upper surface. Extending substantially perpendicular to and upward from the upper surface 412 to the raised surface 414 is a circumferential flange 415. A circumferential edge 416 extends from circumferential flange 415 inward toward the central axis 417 (shown in FIGS. 50*a–e*) of the circumferential flange in a plane substantially parallel to raised surface 414. The combination of the raised surface 414, the circumferential flange 415, and the edge 416 defines a lock receptacle 410 for receiving and engaging a cable lock 440.

As better shown in FIGS. 50*a–e* circumferential edge 416 has an inner surface 418 substantially parallel to raised surface 414 with a dimension 419 sized to permit the insertion of cable lock 440 into the lock receptacle 410 and to securely engage the engagement means 441 of the lock at inner surface 418. In FIG. 49 dimension 419 of edge 416 is sized such that lock receptacle 410 will receive and securely engage any variety of clip-type cable locks known in the art and commercially readily available. Preferably dimension 419 is about 1 to 1.5 millimeters.

An adhesive 411 is coated on the bottom surface 413 of locking mechanism 400. In operation the adhesive 411 engages both the bottom surface of the locking mechanism 400 and the outer surface 451 of the personal valuable 450 thereby securely adhering the locking mechanism 400 to the personal valuable 450. Preferably, adhesive 411 is a glue or glue system, such as those commercially available from the 3M Company, Industrial Tape & Specialties Division, St. Paul, Minn. 55144, including a cyanoacrylate such as 3m Pronto #CA8, an epoxy such as 3m Scotch-Weld #2216, or a double-coated acrylic foam-tape such as 3m VHB #4945 which may be reversed by application of heat, cold or a solvent, neither detrimental to the appearance nor the operation of the personal device, should the user ever desire to remove the locking mechanism from the personal valuable.

The embodiment of FIGS. 49 and 50 may be slightly modified to provide an alternative embodiment 430 in which, in the lock receptacle 410*a* at surface 418*a* of circumferential edge 416*a*, a washer 420 is provided as shown in FIG. 51. Washer 420 may be pressed or glued to surface 418*a* and provides reinforcement to the edge 416*a*.

In FIGS. 52*a* and *b*, an alternative embodiment of the lock receptacle of the locking mechanism 400 according to the present invention is depicted wherein dimension 419*a* of edge 416*a* is sized such that the lock receptacle 410*a* will receive and securely engage a ball-type lock such as that described in U.S. Pat. No. 4,742,703, as well as others known in the art and commercially available. Preferably dimension 309*a* is about 1 to 1.5 millimeters.

FIGS. 53*a* and *b* illustrate another alternative embodiment of a lock receptacle of the present invention, 490, intended to securely engage a one-way latch clip-type lock, a variety of which are known in the art and are commercially readily available. As shown in FIGS. 53*a* and *b*, a spindle 477 extends substantially perpendicular to and upward from the upper surface 472. Spindle 477 has a circular plate 478 at its upper end which extends from spindle 477 outward away from the central axis 479 of the spindle in a plane substantially parallel to upper surface 472. The circular plate 478 has an inner surface 480 and an outer surface 481 .The inner surface 480 provides a means for engaging a latch-type cable lock (not shown).

Thus it is seen that a locking mechanism for securing personal valuables is provided. Persons skilled in the art will appreciate that the present invention can be practiced by other than the described preferred embodiments, which are presented for the purposes of illustration and not of limitation, and the present invention is therefore only limited by the claims that follow.

What is claimed is:

1. A locking mechanism for attachment to a portable device having an exterior wall provided with a restraining slot having predetermined dimensions, comprising:

a housing having a first face for facing engagement with said exterior wall, a mounting cavity and a second face opposite said first face; said second face having an aperture there through;

a restraining member having an inner flange pivotally mounted in said mounting cavity adapted to pivot between an installation position and a locked position, a shank section adapted to extend into said restraining slot, and a hook section adapted to engage an inner surface of said exterior wall through said restraining slot;

a fastener insertable through said aperture in said second face and into said mounting cavity thereby to extend into an aperture in said inner flange when said restraining member is in said locked position to thereby inhibit movement of said restraining member to said installation position; and coupling means for coupling said housing to an object other than said portable device.

2. The locking mechanism of claim 1, wherein said aperture in said inner flange includes a first threaded portion and said fastener includes a second threaded portion complimentary to said first threaded portion.

3. The locking mechanism of claim 1, wherein said mounting cavity includes opposing pivot slots for pivotally mounting therein opposing pivot pins extending from said inner flange.

4. The locking mechanism of claim 1, further comprising a cover for covering an open end of said mounting cavity; said covering having an opening there through permitting said inner flange to pivot between said installation position and said locked position and inhibiting dismounting of said inner flange from said mounting cavity.

5. The locking mechanism of claim 1, wherein said coupling means comprises a lock receptacle for receiving and engaging a lock.

* * * * *